US010253512B2

(12) United States Patent
McAuley et al.

(10) Patent No.: US 10,253,512 B2
(45) Date of Patent: Apr. 9, 2019

(54) ROUGH-IN BOX FOR CREATING PENETRATIONS IN POURED CONCRETE FLOORING AND METHOD OF USE

(71) Applicant: WALK SAFE INNOVATIONS, LLC, New York, NY (US)

(72) Inventors: Gabriel McAuley, Staten Island, NY (US); Donal O'Sullivan, Douglaston, NY (US)

(73) Assignee: Walk Safe Innovations, LLC, New York, NY (US)

( * ) Notice: Subject to any disclaimer, the term of this patent is extended or adjusted under 35 U.S.C. 154(b) by 0 days.

(21) Appl. No.: 15/259,776

(22) Filed: Sep. 8, 2016

(65) Prior Publication Data

US 2017/0067264 A1 Mar. 9, 2017

Related U.S. Application Data

(60) Provisional application No. 62/216,268, filed on Sep. 9, 2015.

(51) Int. Cl.
*E04G 15/06* (2006.01)
*E04G 21/32* (2006.01)

(52) U.S. Cl.
CPC ..... *E04G 15/061* (2013.01); *E04G 21/3204* (2013.01)

(58) Field of Classification Search
CPC ..... E04G 15/061; E04G 21/3204
See application file for complete search history.

(56) References Cited

U.S. PATENT DOCUMENTS 1,507,721 A * 9/1924 Waite ..... E04B 5/326 52/323
3,593,344 A 7/1971 Logsdon
3,625,389 A 12/1971 Bartlow
3,854,620 A 12/1974 Saidla
4,077,599 A 3/1978 Oland
(Continued)

FOREIGN PATENT DOCUMENTS

CA 2752360 3/2013

OTHER PUBLICATIONS

International Search Report (ISR) and Written Opinion (WO) dated Nov. 29, 2016 for International Application No. PCT/US16/50708.

*Primary Examiner* — Rodney Mintz
(74) *Attorney, Agent, or Firm* — Haug Partner LLP

(57) ABSTRACT

A rough-in box used during the construction of buildings having poured concrete flooring, such as multi-story high-rise buildings. The rough-in box may be used to retain an opening in the floor through which plumbing and mechanical components may be installed after concrete has been poured around the device and hardens into a slab. The present invention also relates to a method comprising the steps of assembling the side walls of a box, placing a lid made of a material stronger than that of the side wails and capable of supporting a weight of 2,000 pounds, placing the box over a hole on the floor, and pouring concrete to form a floor around the box. The box will remain in place providing an accessible penetration through the flooring with space for plumbing connections and a flush surface with the floor over which pallet jacks and workers may travel without obstruction.

33 Claims, 24 Drawing Sheets

(56) References Cited

U.S. PATENT DOCUMENTS 4,493,173 A * 1/1985 Kohaut ..... F16L 5/04 174/482
4,666,388 A 5/1987 Kovasna et al.
4,823,527 A 4/1989 Harbeke
5,305,568 A 4/1994 Beckerman
5,309,688 A 5/1994 Robertson
5,390,465 A 2/1995 Rajecki
5,417,019 A * 5/1995 Marshall ..... A62C 2/065 52/220.8
6,088,972 A 7/2000 Johanneck
6,786,463 B1 * 9/2004 Collum ..... B28B 7/30 249/134
6,848,227 B2 * 2/2005 Whitty ..... H02G 3/22 174/482
7,073,766 B2 7/2006 Schwoerer
7,080,486 B2 7/2006 Radke et al.
7,478,503 B2 * 1/2009 Milani ..... E04B 5/48 277/615
7,533,499 B2 * 5/2009 Daigger ..... E03F 5/0407 404/25
8,001,737 B1 8/2011 Price
8,272,082 B1 9/2012 Price
9,046,194 B2 * 6/2015 Gandolfo ..... F16L 5/04
9,347,217 B2 * 5/2016 Feuer ..... F24F 13/0263
2004/0016191 A1 * 1/2004 Whitty ..... F16L 5/04 52/232
2005/0055916 A1 3/2005 Daigger et al.
2006/0096195 A1 * 5/2006 Zierer ..... E04G 15/061 52/220.1
2008/0217339 A1 9/2008 Arn
2009/0218130 A1 * 9/2009 Monden ..... E04G 15/061 174/505
2010/0084540 A1 * 4/2010 Talley ..... E04G 15/061 249/1
2013/0216759 A1 * 8/2013 Lauro ..... E04G 15/063 428/68
2015/0047276 A1 * 2/2015 Gandolfo ..... F16L 5/04 52/220.8
2015/0266260 A1 * 9/2015 Fujioka ..... B32B 3/30 428/118
2015/0300002 A1 * 10/2015 Feuer ..... F24F 13/0263 49/464

* cited by examiner

ROUGH-IN BOX FOR CREATING PENETRATIONS IN POURED CONCRETE FLOORING AND METHOD OF USE

CROSS REFERENCE TO RELATED APPLICATION

This application claims priority from U.S. provisional application 62/216,268 filed on Sep. 9, 2015, the contents of which are incorporated herein by reference.

BACKGROUND OF THE INVENTION

1. Field of the Invention

The present invention relates generally to a rough-in box for creating penetrations in poured concrete flooring during the construction of high-rise buildings, and a method of using the device.

2. Background

Currently there are a number of solutions for creating penetrations in concrete slab flooring during the construction of high-rise buildings. The penetrations may then be utilized for the installation of plumbing, ducts or other mechanical systems between floors. It has been known to install plumbing or mechanical systems through concrete floors by knocking out holes in the floor or boring such holes after the floor has been formed, and then extending pipes or other conduits through the floors. After the conduits have been inserted into the holes, workers have to pour additional material such as more concrete or caulking material to seal up the spaces between the voids and the conduits extending through the penetrations. However, such attempts to use concrete or caulk to seal up the spaces has not been effective at preventing future problems such as water leaks that travel through any void spaces between the floors. These solutions fail to meet the needs of the industry because they are also time-consuming, labor intensive and wasteful of construction material.

Other solutions include the on-site fabrication of plywood boxes. The boxes are constructed so as to be placed over a roughed-in floor drain area or other location where a floor penetration is desired. The rough-in plywood construction is normally used in order to isolate and protect the rough-in drain at the time of the pouring of a concrete (or cement) floor. But these solutions are similarly unable to meet the needs of the industry because once the flooring is poured the framed openings must be covered with plywood to allow continued construction activity. The plywood creates an uneven floor surface which is a tripping hazard for construction workers and hinders the movement of pallet jacks and other wheeled devices used to deliver construction materials to the needed locations at the site. Furthermore, the wooden frames must be forcibly removed after the concrete is poured, a process which is time consuming and labor intensive.

Other solutions involve the use of metal boxes which are secured to the deck of the floor prior to pouring. This solution has many of the same problems as the use of wooden frames. For example; the metal boxes must be forcibly removed by workers before the concrete is completely cured, creating the need to repair damage to the floor caused by the removal process and the footprints of the workers. When the boxes are removed, the impression hole that is left also needs to be covered to prevent injuries incurred by falling in the hole.

Still other solutions seek to use cylindrical forms or tub-shaped, open-top boxes but these solutions also fail to meet industry needs because they do not provide a flush surface with the flooring. The tubs must be covered with plywood or filled with a foam insert to allow continued construction activity. The cylindrical forms typically protrude above the floor surface creating obstacles. If flush with the floor they must be covered with plywood which creates the problems discussed above.

However, none of the forms described above are suitable for bearing the weight of workers and construction vehicles/equipment/materials while at the same time not creating an uneven floor surface which could be a tripping hazard for construction workers and which could hinder the movement of wheeled devices. Moreover, none of the forms allow construction to continue without the need to remove or trim the forms or covers, such as plywood covers, placed over the forms during the pouring of concrete. There has been no suggestion that the cover to the form should be of a strength that can provide support for both workers and vehicles/equipment/materials that are moving and working on the floor.

With respect to the method of creating penetrations in poured concrete flooring during the construction of high-rise buildings, a typical current construction method using removable metal boxes generally includes the following steps:

(1) The boxes are lifted and placed by crane on the floor that is being readied to be poured.

(2) The boxes are then carried and placed on the prearranged spots on the deck. Depending on the size of the box this may require two workers.

(3) The box is tied to the rebar to prevent the box from being moved or dislodged during the concrete pouring process.

(4) The box is greased to facilitate removal from the concrete.

(5) The concrete is poured to create the slab.

(6) The surface is smoothed to make it flat and level.

(7) To prevent the boxes from becoming stuck in the concrete when it has hardened, when the concrete reaches 75% cure, two workers pry the steel box from the curing concrete. This process damages the surface of the concrete with footprints and also the edges of the hole created by the steel boxes are roughened from the prying action.

(8) The surface of the concrete must be refinished to remove the footprints and other surface damage resulting from removal of the boxes.

(9) During the pouring process, some concrete overflows into the boxes, and when the boxes are removed the hardened concrete has to be removed from the box. This cleaning process requires two workers to strike the box sides with sledgehammers to loosen the concrete and then chip out the remainder with a scraper or chisel.

(10) The cleaning debris is collected and removed from the floor for disposal.

(11) The cleaned boxes are then stacked, ready to be moved to the next floor.

(12) Before the supports and framing for the next floor can be erected, the open holes have to be covered to prevent injuries. Sheets of plywood are placed over the hole and nailed to the concrete to act as a cover.

This method does not meet the needs of the industry because it has many inherent problems and inefficiencies, some of which are now discussed.

Once the plumbing or mechanical penetrations in one floor are covered, the erection process for the next floor can begin. The support legs for the next floor are put in place and the wooden deck is installed. Due to the presence of the penetrations and wooden covers, the legs sometimes must be placed in different orientations to avoid having the legs being placed on a penetration cover which the leg could potentially puncture. During the erection and pouring process, the wooden penetration covers become dislodged by workers accidentally kicking or knocking the covers loose during the course of working on the erecting floor. Thus, the covers have to be refastened to the floor to prevent workers being injured by stepping into holes.

When a floor is set and ready to be worked on, the stripping and moving of materials and forms can begin on the floor below. This process involves heavy traffic on the floor with the covers in place, and often the covers are dislodged again and must be refastened.

Generally, while the covers are in place, the concrete contractor must maintain the covers for six floors until the general contractor assumes control of the floor to allow the other tradesmen to conduct their work. This maintenance typically consists of daily inspections of the penetration covers on each floor to ensure they are still correctly positioned and fastened to the floor, and refastening loose covers. Once the general contractor takes control of the floor they remove the wooden covers that were covering the penetrations and replace them with a thicker cover that has mitered edges. The old covers then need to be removed from the floor to prevent tripping hazards.

When the plumber or mechanical contractor is ready to begin installing pipes or other conduits in the penetration, it could be almost one month since the slab was poured. Since the holes become roughened from the prying process during removal of the boxes, the holes may need to be adjusted to fit the needs of the particular installation. Once the piping has been completed, the holes need to be filled with concrete to maintain the fire stopping ability of the concrete slab. Due to the fact that this is done at the stage when the units are having the finishing touches applied, it can lead to the some items being scuffed or damaged.

When the mechanical services are ready to run shafts and ducts, they must physically strip the wooden boxes from the cured concrete which is time consuming and also can roughen the sides of the penetration. The penetrations must also he filled with a material to maintain the fire stopping ability.

Suggestions have also been made to provide such cylindrical form or tube with lids to prevent concrete from being poured into the forms. Such forms are described, for example, in U.S. Patent Publication 2005/0055916 describing a plasticized form which is used to surround plumbing fixtures while concrete is being poured and has a lid secured to the form that provides an intermediate covering to the form assembly and until such time as the plumber completes the connection, U.S. Pat. No. 7,080,486 describes including intumescent material in a leave in place form which may be provided with a cap, the form being provided with frangible bands to allow adjustment of the form to the thickness of the floor. The cap is stated to be used to prevent concrete from being poured into the form. U.S. Pat. No. 4,823,527 describes a hollow form having a cover that can be coplanar with the top surface of a concrete floor and means for adjusting the height at which this form is located above the floor support. U.S. Pat. No. 4,077,599 describes an aperture-forming device for making openings, for example tubular openings in concrete. U.S. Pat. No. 7,073,766 describes a form work having a moveable outer frame linked to an inner rigid frame thereby permitting adjustment of its size. U.S. Pat. No. 4,666,388 describes a form for forming an opening such as a window or door which is adapted to collapse inwardly after use.

It would be desirable to have a device and method of using the device that can be used to retain an opening in concrete slab flooring during the pouring of the concrete which is capable of providing an upper surface flush with the concrete floor, has the structural strength to support the weight of workers and construction supplies, can remain in in place after construction and has waterproofing and fireproofing capabilities. This would eliminate the need to cover openings with plywood, which creates a tripping hazard for construction workers and impedes the movement of wheeled carts and trucks which are used to move materials around the construction site. Still further, it would be desirable to have a device that provides a waterproof and fireproof barrier. Still further, it would be desirable to have a device and method that provides for improved efficiency, increased safety, and reduced labor costs. Therefore, there currently exists a need in the industry for a device and associated method that provides for an opening in poured concrete flooring, with an upper surface which is flush with the surrounding floor, strong enough to support the weight of construction materials and workers, waterproof, fireproof, and cost effective. Therefore, there currently exists a need in the industry for a device and method of use that solves all the problems addressed above.

Specifically there is a need for a form that can be used to enable penetrations to be left in a concrete floor while concrete for the floor is being poured, that can permit work on the floor to continue without the need for removal of materials, that provides a. fireproof and waterproof barrier and desirably can easily accommodate different sized penetrations.

SUMMARY OF THE INVENTION

The present invention advantageously fills the aforementioned deficiencies by providing a rough-in box for creating penetrations in concrete flooring and a method of use which creates a penetration in the flooring while providing a flush surface with the floor which can support the weight of workers and equipment, can remain in place post-construction and provides waterproofing and fire proofing capabilities. The present invention further provides a method using such boxes.

The present invention provides a structure for forming openings in poured concrete slab flooring, which is made up of the following components: one or more boxes, for example two boxes, forming an opening of a desired shape. Rectangular side walls can be used for forming a box having the shape of a rectangular prism, and curved side walls can be used for forming a circular or elliptical box.

In a particularly useful embodiment, each box has a pair of short and long sides, a bottom side and top side. The top side is strong enough to permit workmen and their equipment to move over it without risk. The strength required of the top depends on the particular situation in which the box is being used. Conveniently, the box is formed on site from pre formed side pieces. It is usually desirable that the top piece is customized for a particular site. To facilitate on-site assembly of a box, the edges of each of the side pieces are designed to permit quick interlocking between them to form the four sides of the box and are preferably formed with a flange that once the sides have been assembled will be at the top of the assembly to provide support for the top.

In one embodiment, the boxes have four sides of equal height and a top side. If the penetration desired is for mechanical systems, a square box may be used, and if the penetration requires two boxes, then the boxes can be connected as follows: the boxes are connected with the short side of the first box attaching to the long side of the second box to form the shape of the letter T or letter L, or a linear shape. Where the sides of the boxes abut, there will be an opening in the wall of each box to allow access between the two boxes for subsequent plumbing installation. The top side of each box will be removable. One of the boxes may have a circular opening in the bottom side, through which a cylindrical frame may be extended downwards to provide a full penetration through the resulting slab floor. One box may have a height less than the thickness of the floor and be supported by legs of sufficient height to make the top surface flush with the floor surface. When the desired configuration has been created, the device is placed in the required position on the deck of the floor. Concrete is poured onto the deck and cured. The top sides of the boxes will sit flush with the floor surface to allow for pallet jacks and other wheeled carts to be moved over the covered openings without hindrance and without the need for plywood coverings which create tripping hazards.

The present invention may also have one or more of the following: The boxes may be constructed to he water tight to prevent water traveling through the floor penetration. The boxes may be constructed entirely or partially of a fireproof material. The boxes may also incorporate intumescent material as a means of fireproofing the penetration. Similarly, the method associated with the present invention may also include one or more of the following steps: installing waterproofing devices, installing fireproofing devices.

The present invention is unique when compared with other known devices and solutions because the invention provides: (1) a structure which creates a slab pass-through and a void space for plumbing, mechanical, or other access (2) which also has a closed top that is flush with the slab floor and can support the weight of construction workers and material; (3) provides waterproofing and fireproofing protection and (4) can remain in place after the concrete cures. Similarly, the associated method is unique in that it: (1) eliminates the time and labor of constructing and installing wooden covers on-site, (2) eliminates the time and labor removing frames from cured concrete, and (3) eliminates obstructions and tripping hazards at the construction site.

The present invention is unique in that it is structurally different from other known devices or solutions. More specifically, the present invention is unique due to the presence of (1) A solid top lid; (2) rectangular or square shaped structures for both the pass through section and plumbing connector as well as full penetration sections for shafts or mechanical systems; and (3) rigid construction which can support the weight of workers and material. Furthermore, the process associated with the aforementioned invention is likewise unique and different from known processes and solutions. More specifically, the present invention process owes its uniqueness to the fact that it: (1) achieves as good or better results than conventional methods in fewer steps, less time, less labor, less cost, and has safety advantages.

Among other things, it is an object of the present invention to provide plumbing boxes and mechanical boxes for creating penetrations in concrete flooring and method of use that does not suffer from any of the problems or deficiencies associated with prior solutions.

It is still further an objective of the present invention to create a device that is more economical to produce, easier to manufacture, easier to ship to the work site, easier to install and of sufficient durability to remain in place after construction is complete.

Further still, it is an objective of the present invention to create a device that is amenable to mass production in a variety of standard dimensions frequently encountered in the industry, thereby enabling the device to be more easily commercialized.

In a preferred aspect of the present invention, the boxes are of modular construction in which pre-formed components may be assembled on site to form boxes of the appropriate size for the desired penetration. Typically, the components form the side walls of the box and are fitted together by a specific interlocking mechanism as described below. The tops of these wall members provide a flange on which the cover may be placed.

The side walls may be formed of any strong, tough material which may vary in accordance with the particular application or circumstances under which the rough-in box is to be used. For example, the side walls may be made from metal alloys, fiberglass, and heavy duty plastics, or any combination thereof. Examples of heavy duty plastics include polyethylene, polyvinyl, and polypropylene. In one particular embodiment, the side walls are made from a magnesium aluminum alloy, such as the aluminum 5000 series, and may have a thickness in the range of 0.03 to 0.1, for example, 0.050 inches. Other properties such as weight can be relevant to the choice of material for the side walls of the rough-in box.

The top lid on the other hand needs to be strong enough to provide a working surface on the floor while construction is being carried out. As such, the top lid must be capable of supporting a weight of at least 2,000 pounds and in some applications of supporting weights of up to 20,000 pounds. The lid can be made from a broad range of fiberglass, and can also be made from heavy duty plastics such as polyethylene, polyvinyl, and polypropylene. Additionally, in some embodiments, the lid can be made from engineered wood. It is also possible that the lid is made from a combination of fiberglass, heavy duty plastics, and/or engineered wood.

In one embodiment, the top lid can be made of resin impregnated fiberglass with the density of fibers being determined by the weight that the closure has to bear. Generally, the number of piles or layers of fibers will affect the flexural strength of the lid as will be further discussed below. The resins used to impregnate the fiberglass may include epoxy resins as well as other types of thermosetting plastics such as polyester or vinylester resins and thermoplastics.

The lids may be custom made to have a fixed size for particular sized penetrations or can have an adjustable size as described below. Lids of adjustable size may be used, for example, by providing corrugations in defaces of different parts of the lid so that they can inter-lock with each other while maintaining a strong support. If desired, the lid can be supported by strut stretching across the box from an opening or vertical slot in one wall to an opening or vertical slot in the opposite wall.

In another aspect, the present invention provides a method for constructing a floor containing penetrations which comprises: assembling the walls of a box as described above, locating such boxes on a floor deck, placing a top being made of a material stronger than that of the sidewalk and being capable of supporting a weight of 2,000 pounds on to the top of said box, pouring concrete to form a floor around said boxes, performing work on said floor after pouring the concrete and subsequently removing said top, leaving the remaining parts of the box in situ in the concrete, and installing plumbing or electrical fittings within said box.

In a further embodiment, the walls of the box, irrespective of whether the walls are a fixed size or the wall lengths are adjustable, is provided with a groove into which fire proofing or fire retardant is injected or inserted.

In a yet further embodiment of the invention, the box components or the lid are provided with elements from which a guard rail may be provided to surround the perimeter of the penetration.

To comply with safety regulations, the upper surface of the lid will be a bright color (yellow and orange being typical) and will be provided with a non-slip upper surface.

In a preferred embodiment, the size of the box is adjusted to a predetermined size prior to being located on the floor deck. One way to accomplish this is by using sidewalk of adjustable length as described below.

The present invention will now be described more fully hereinafter with reference to the accompanying drawings, which are intended to be read in conjunction with both this summary, the detailed description, and any preferred and/or particular embodiments specifically discussed or otherwise disclosed. This invention may, however, be embodied in many different forms and should not be construed as limited to the embodiments set forth herein. Rather, these embodiments are provided by way of illustration only so that this disclosure will be thorough, complete, and will fully convey the full scope of the invention to those skilled in the art.

BRIEF DESCRIPTION OF THE DRAWINGS

FIG. 22 shows a plan section view of the assembled rough-in box.

DETAILED DESCRIPTION OF THE INVENTION

The present invention is directed to a plumbing and mechanical rough-in box for creating penetrations in concrete flooring and a method of use.

In a first embodiment of the present invention, two boxes in the shape of rectangular prisms are constructed. The side walls of the boxes may be formed of any strong, tough material such as, for example, metal alloys, fiberglass, and heavy duty plastics such as polyethylene, polyvinyl, and polypropylene. In one embodiment, for example, the side walls can be made from an aluminum 5000 series alloy having a thickness of 0.050 inches. In another embodiment, the side walls can be made from high strength/low ductility plastic.

Figure 1:
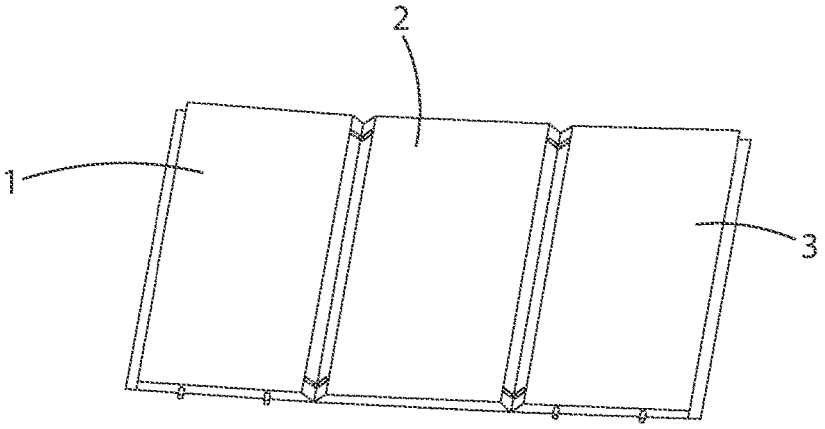
FIG. 1 shows a bottom and two foldable sides of a first plumbing box lying flat.
Figure 2:
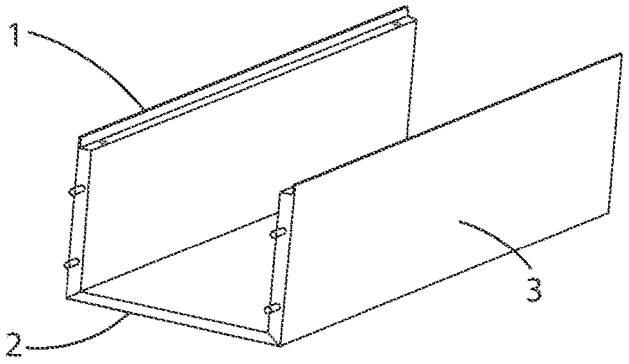
FIG. 2 shows the bottom and two foldable sides folded upward to a position perpendicular to the bottom of the first plumbing box.
Figure 3:
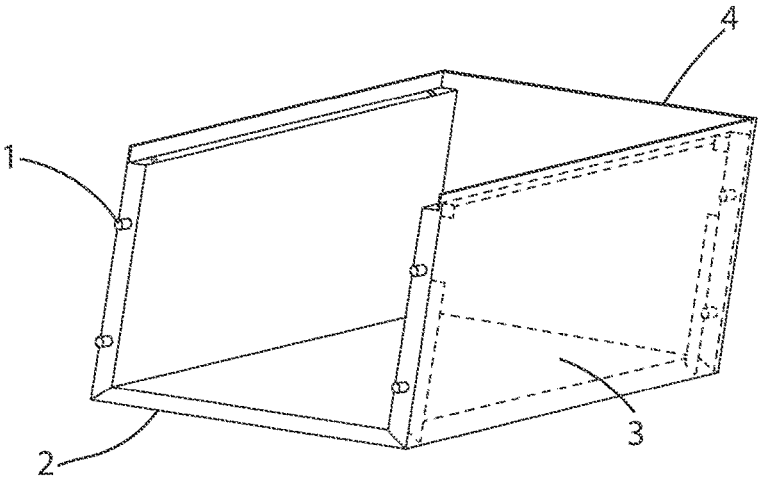
FIG. 3 shows the first plumbing box of FIG. 2 with a side attached.
Figure 4:
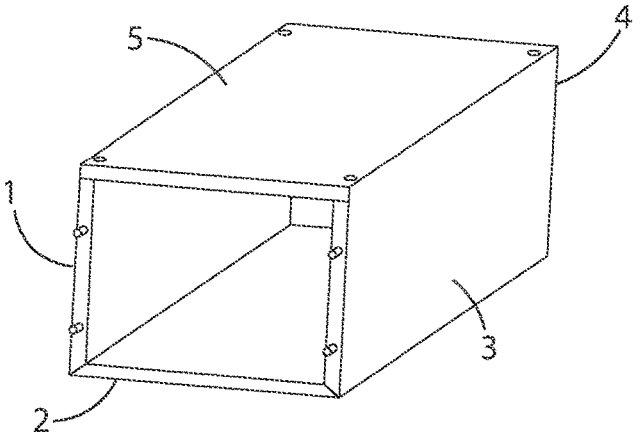
FIG. 4 shows the first plumbing box of FIG. 3 with a top attached.
Figure 5:
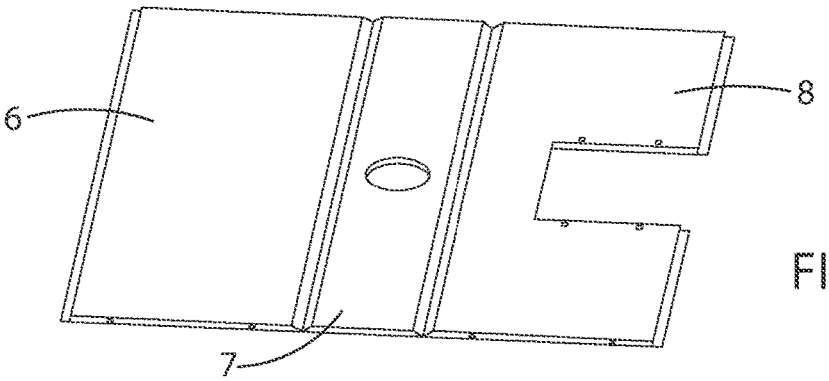
FIG. 5 shows a second plumbing box with foldable sides lying flat with bottom; the bottom and side having cut-out holes.
Figure 6:
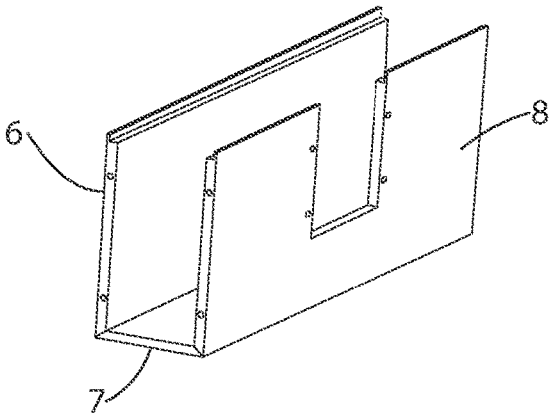
FIG. 6 shows the second plumbing box of FIG. 5 with the sides folded upward to a position perpendicular to the bottom.
Figure 7:
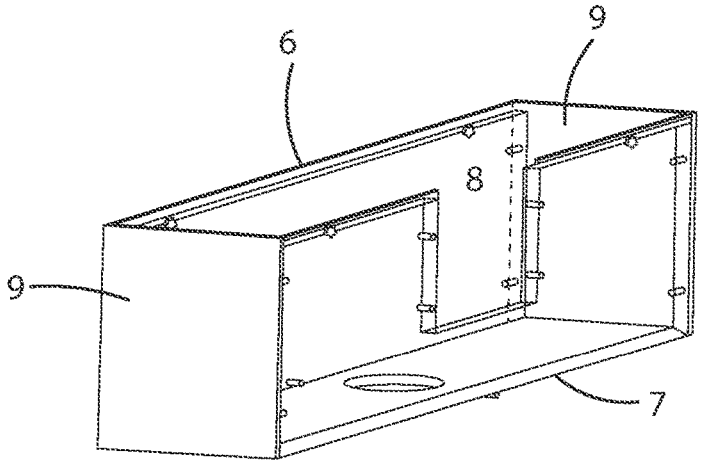
FIG. 7 shows the second plumbing box of FIG. 6 with two sides attached.
Figure 8:
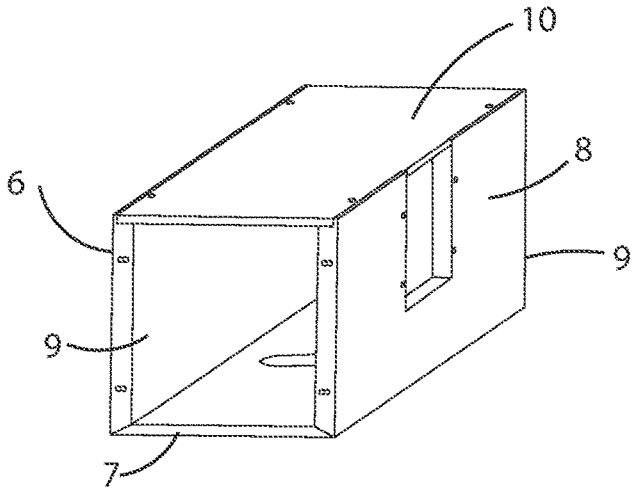
FIG. 8 shows the second plumbing box of FIG. 7 with a removable top attached.

A first box is assembled from a panel consisting of the bottom (2) and long sides (1, 3) of the box shown in FIG. 1. Channels in the panel having a bevel of 45 degrees from the panel surface allow the sides (1, 3) to be folded upwards to create 90 degree angles with the bottom as shown in FIG. 2. A short side (4) is connected to one end of the box by locking slot and tab connectors shown in FIG. 3. A top side (5) is connected to the box by slot and tab means shown in FIG. 4.

Figure 9:
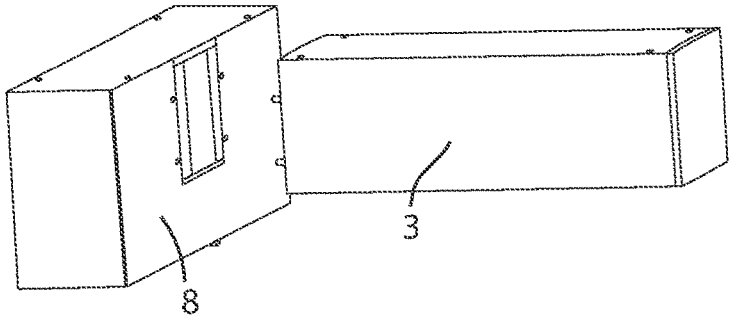
FIG. 9 shows the first and second plumbing boxes of FIGS. 4 and 8 positioned so that the open side of the first box aligns with the cut-out opening of the second box.
Figure 10:
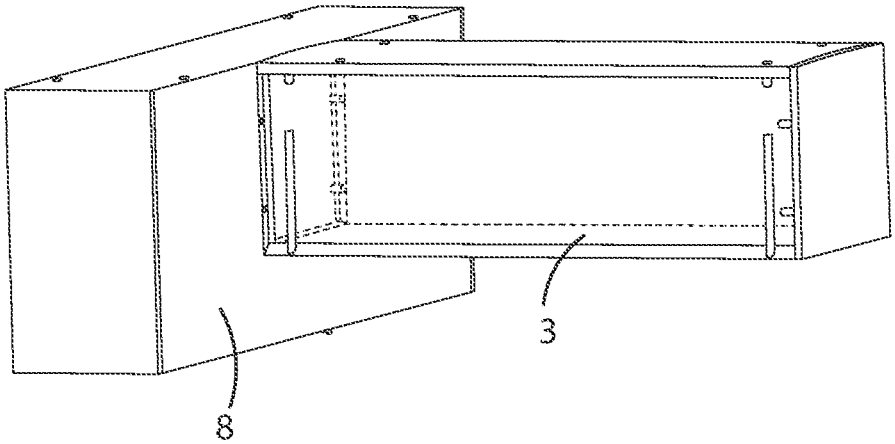
FIG. 10 shows the two boxes connected.
Figure 11:
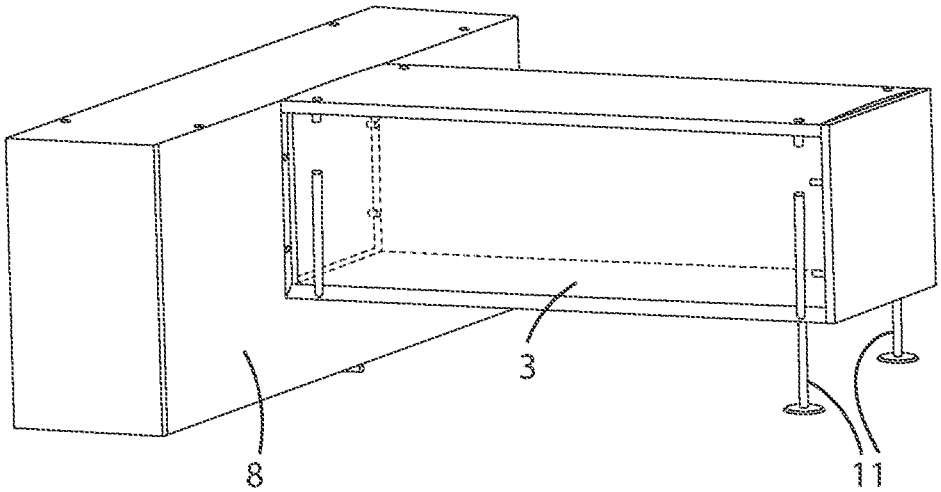
FIG. 11 shows the boxes of FIG. 10 with adjustable feet installed on the first plumbing box section.

A second box, is assembled in the same fashion as the first box with a bottom (7), long sides (6, 8), and a short side (9) except the bottom (7) and side panel (8) of the second box will have a circular opening in the bottom side (7) and rectangular opening on one of the long sides (8) as shown in FIGS. 5, 6, 7, and 8. The openings will each be centered the same distance from a short side of the box. The openings will be equidistant from the sort sides to create a T-shaped structure or proximate to one short side to make an L-shaped structure. The open end of the first box is aligned with opening in the side (8) of the second box as shown in FIG. 9. The boxes connect using slot and tab means shown in FIG. 10. Two metal feet or adjustable-height legs (11) having a height are placed on the bottom side of the first box as shown in FIG. 11.

The boxes are connected by first having the metal feet (11) attached to the outer surface of the bottom of the first box, close to the closed end of the box. The open end of the first box is then aligned with the rectangular opening in the long side of the second box as shown in FIG. 9. The boxes will be fastened together by means of locking slot and tab connectors. The boxes for use with penetrations for mechanical systems can be assembled by connecting for a series of flat side similar to those used in the plumbing boxes, to make a square or rectangular shape that will have a lid attached to the upper surface of the walls.

This first embodiment of the present invention solves many of the labor inefficiencies and costs incurred when creating penetrations for plumbing boxes in concrete slabs. When the new boxes arrive on site they are assembled prior to installation in the slab. They are delivered to the floor to be poured, and from there they are installed in a prearranged spot on the deck. To fasten the boxes in place, they are simply nailed to the wooden deck and are then ready for the pouring process. No greasing is needed as they are a permanent fixture in the floor. When the pouring is taking place the workers can work faster because they do not have to worry about accidentally filling the boxes, and the smoothing tools can run over the lid of the box without concern of damaging the box or the hole. Also, the additional damage caused from workers walking on the concrete to pry out the boxes is avoided, thereby eliminating the need to perform additional surface finishing work. As the boxes are permanent fixtures, there is no additional time wasted in cleaning the boxes of excess concrete that may have overflowed into the box during the pouring of the concrete.

When the floor has hardened, the erecting process can begin. Like in conventional processes, when the legs are being erected to support the next floor they have to be placed so as to avoid the boxes, but the workers can easily identify the edges of the box and be assured that the leg is placed securely on concrete in a position that is as close as possible to the ideal placement orientation. During this stage, avoiding the use of plywood hole covers becomes a great benefit. Their absence from the floor (enabled by the structural lid component of the box) means that tripping hazards are eliminated, thereby eliminating job stoppages due to health and safety requirements. Their omission also increases the speed at which workers can operate as they can move carts and dollies freely about the floor to move materials without having to navigate around the hole covers sitting above the level of the concrete surface. When the floor is stripped (legs and deck removed), workers can perform tasks much more quickly and efficiently because they can use carts and dollies to move materials and forms, as opposed to moving everything by hand, as is often done in conventional processes. After the floor is stripped, tradesmen can begin working on the floor immediately because the holes will not need to be re-covered.

According to in conventional processes, the covers must be inspected once per day for each floor. The present invention would drastically reduce this requirement, if not eliminate it completely, as the structural capabilities of the lid would mean that the boxes would be able to withstand the loads and forces present on the site without failure. The reduction in inspection frequency would save on labor costs for the duration of the construction phase.

When the general contractor takes control of the floor, they do not need to add the additional covers for the holes. The plumber and mechanical services can immediately take responsibility for the boxes and run the pipework or shafts needed. Once complete, the plumber or other tradesman can lock the lid in place sealing the pipework or other components in position. Due to the stopping ability of the box, derived from its construction material, plugs and seals, the slab maintains its stopping ability. Therefore the holes do not need to be filled with concrete. This avoids any potential damage to the nearly finished unit caused by workers filling the hole with concrete and also reduces labor costs significantly.

The proposed method greatly improves existing methods by the fact that it increases productivity and reduces labor costs, while also reducing the potential trip or fall hazards present with existing methods, which in turn reduces job stoppages from falls and injuries.

In one embodiment, the walls are made of an aluminum 5000 series alloy having a thickness of 0.050 inches to keep the box as light as possible. The lid is from 18 to 40 fiber glass layer strands of fiber depending on the engineering requirements for the maximum weight required on said floor. This will insure 100% storage on the floor slab while being strong enough to hold any required weight for full axes to the complete floor.

In one embodiment of the invention, an attachment with concentric rings may be attached to the bottom of one of the box sections to provide full penetration of the slab. The rings may be internally and externally threaded to allow the rings to be threaded into each other to create variable height dimensions. Depending on the height of penetration needed the rings can be threaded into each other to correspond to the required dimension. The threaded design also gives the box vertical support in that the weight of the box could be supported without the need of additional bracing/legs.

In another embodiment, plugs or seals are incorporated into the two plates of the component that would fit tightly to the pipe to increase the water resisting abilities of the box. An intumescent based seal or plug can further increase the water resistance of the box.

Figure 12:
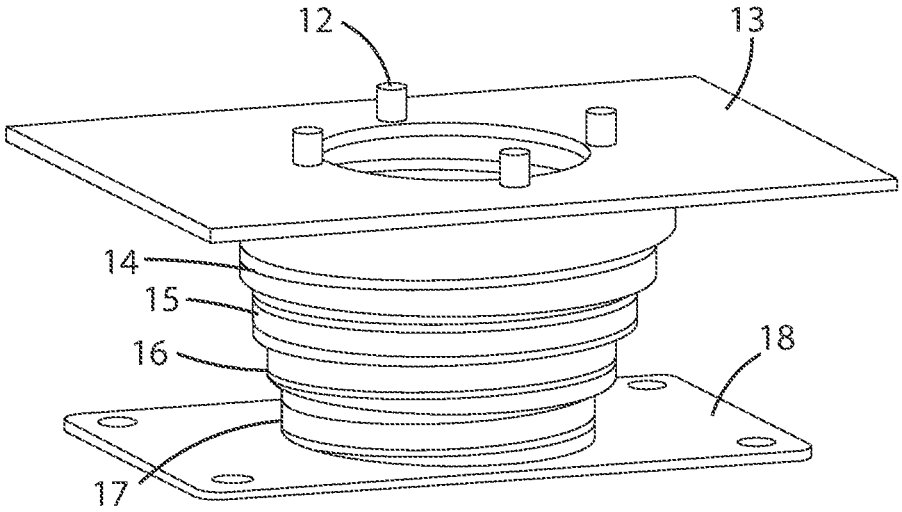
FIG. 12 shows an embodiment of the invention with a component that attaches to the bottom surface of one section of the box.

FIG. 12 shows a component having a series of concentric rings (14, 15, 16 and 17) that are internally and externally threaded. These rings are housed between two plates (13, 18). The component is attached to the bottom of the box surface by way of a fastening mechanism (12) on the top plate of the component (13) that connects with a receiver hole/latch in the base of the straight box. The component is fastened to the deck with nails via holes in the base plate (18).

Figure 13:
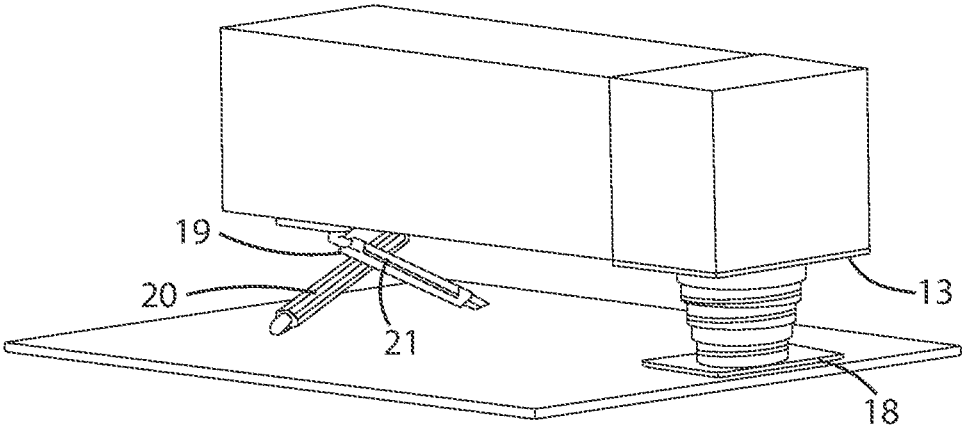
FIG. 13 shows the box with adjustable feet and the components of FIG. 12 to create the full penetrative height of the hole through the slab, and to also allow the passing of a pipe into the body of the box.

As the penetrative height may be made adjustable via the concentric ring structure, so too may the leg supports that are supporting the box. Another embodiment of the invention incorporates adjustable legs as can be seen in FIG. 13. The design consists of two legs, 19 and 20, in an "X" formation that move in a "scissor" action around a central pivot point/pin, 21, that can lock in place at a desired height. The legs are adjusted by releasing the locking pin, which allows the legs to be manipulated to correspond to the desired height, when the height is achieved the locking pin is then re-inserted through the travel slot in one leg through to the locking hole in the other leg, to lock the leg height in place.

In another embodiment of the present invention, the components depicted in FIGS. 14-42 may be used. As in the first embodiment, these components may be assembled on site.

Figure 31:
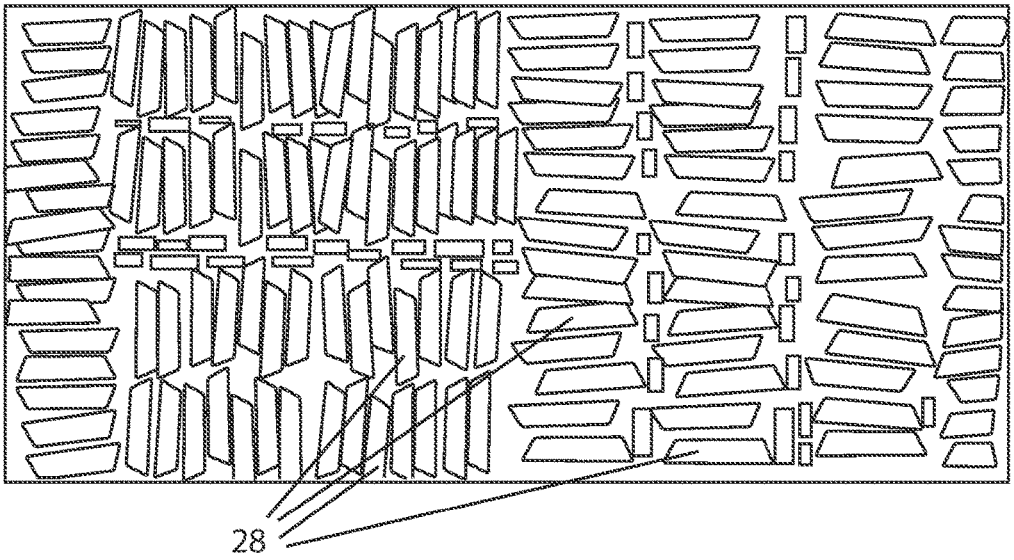
FIG. 31 shows components capable of being flat packed such that they fit together when stacked on top of one another.

FIG. 31 shows that these components are capable of being flat packed such that they fit together when stacked on top of one another. This saves space when transporting and storing the components. Thus, the components can be delivered with fewer trucks, and take up less storage space at the jobsite.

In this second embodiment of the present invention, the components will be supplied with a male component (25) pre-positioned within a female component (22) for forming each side wall of the rough-in box (28). The male members (25) may be fully within the perimeter of the female members (22), and then the lengths of the side walls can be adjusted to the appropriate length by withdrawing the male member (25) from the female member (22). Once the appropriate side wall length is obtained, the male and female members (22, 25) are secured to each other to form one side wall of the rough-in box (28).

Figure 14:
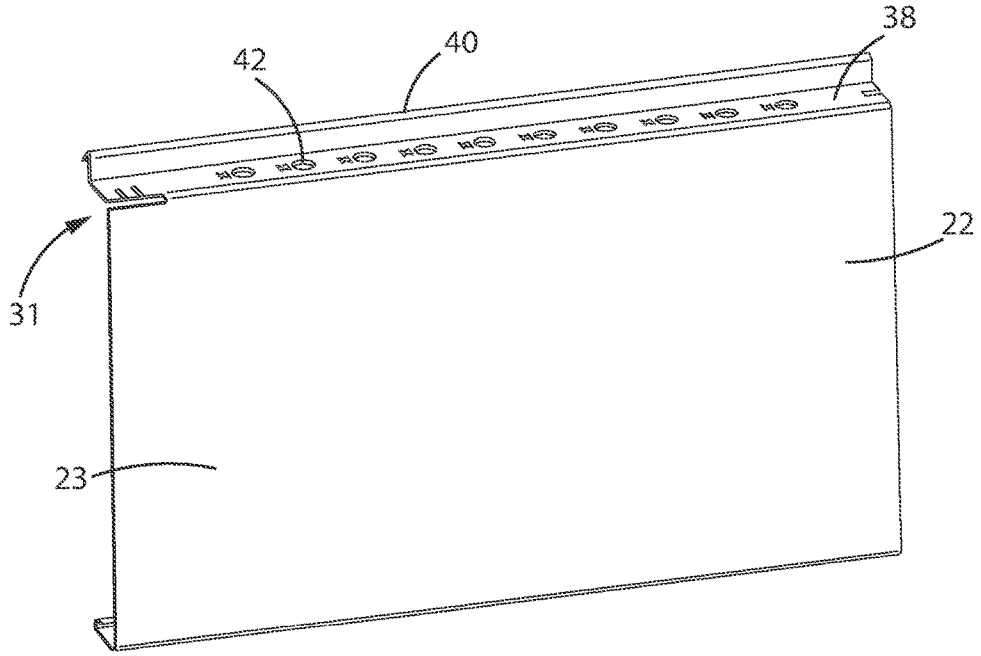
FIG. 14 shows one side of a female member used in assembly of a rough-in box.
Figure 15:
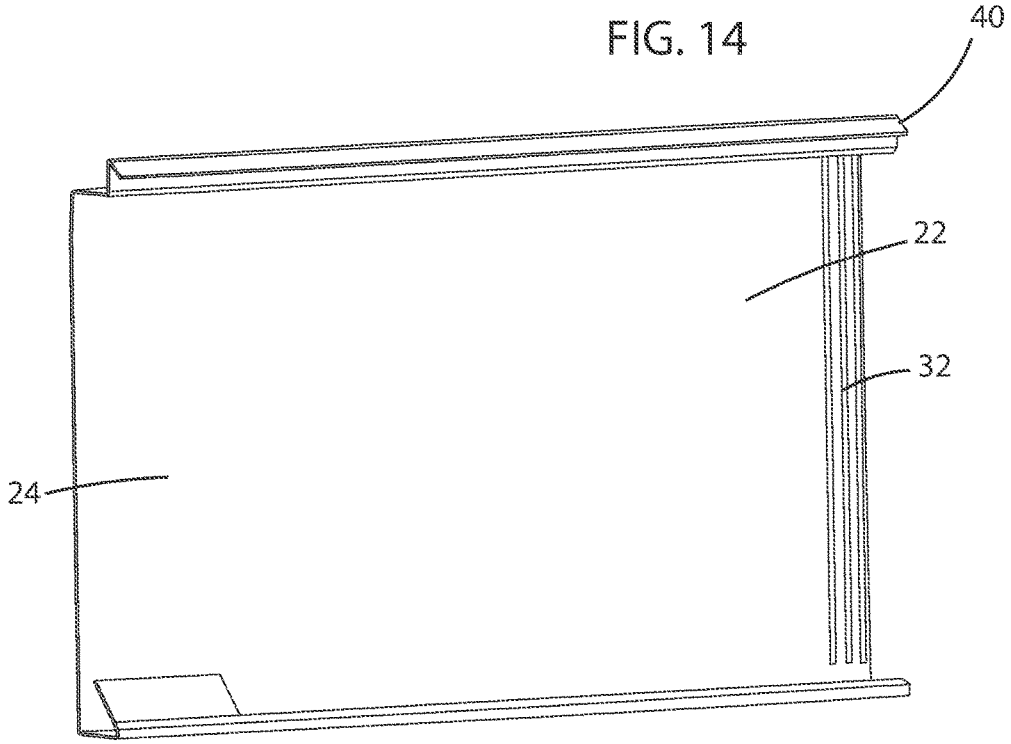
FIG. 15 shows the e other side of a female member of FIG. 14.
Figure 16:
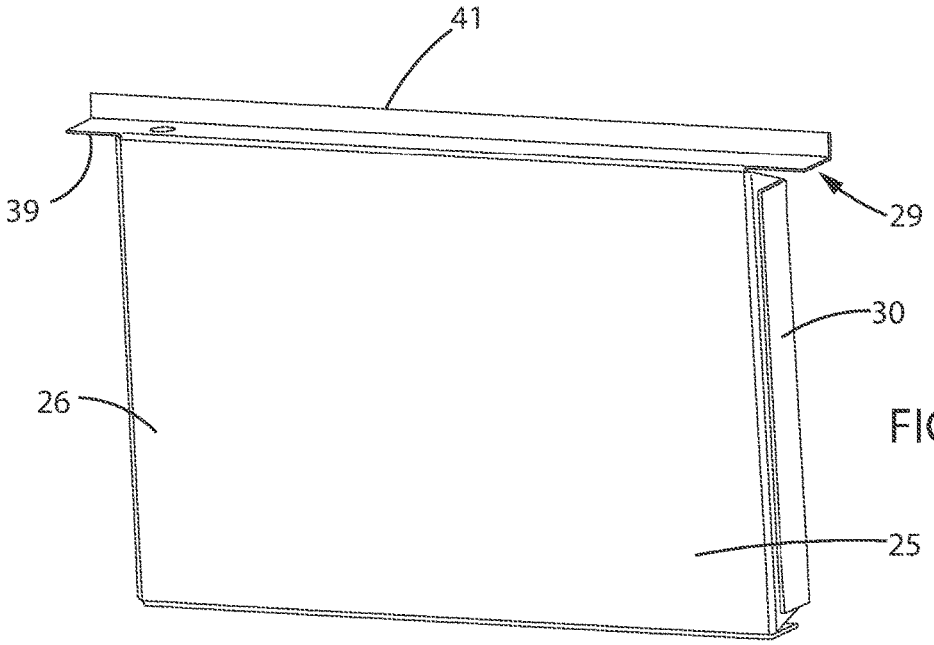
FIG. 16 shows one side of a male member used in assembly of a rough-in box.
Figure 17:
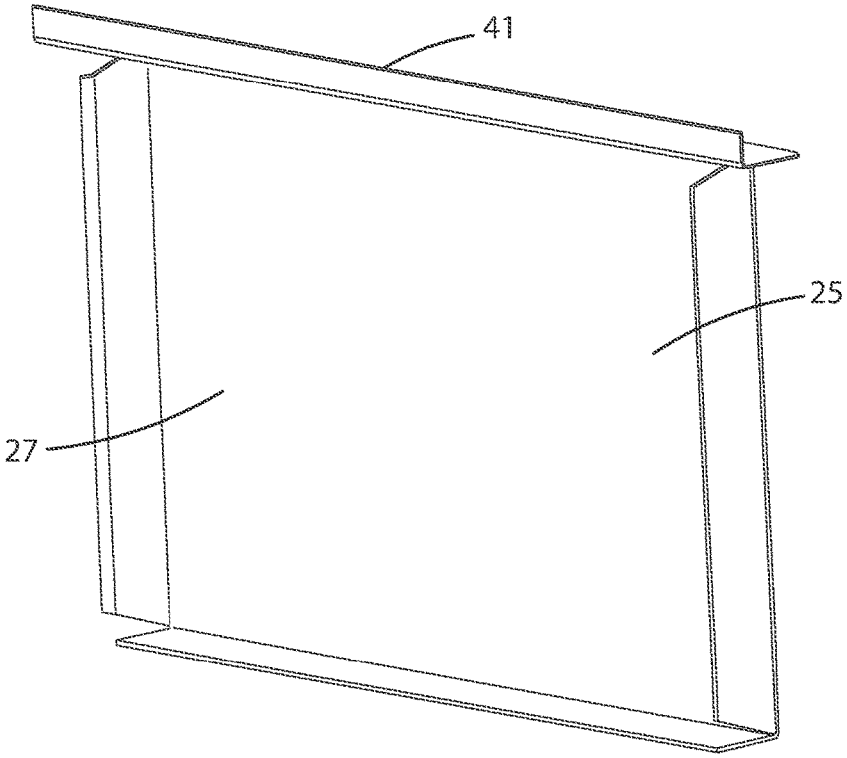
FIG. 17 shows the other side of a male member of FIG. 16.

FIG. 14 shows an external side (23) of the female member (22) and FIG. 15 shows an internal side (24) of the female member (22). FIG. 16 shows an internal side (26) of the male member (25) that faces the internal side (24) of the female member (22) when the male member (25) is engaged with the female member (22). FIG. 17 shows an external side (27) of the male member (25) that will face the outside of the rough-in box (28) shown in FIGS. 20 and 21.

Figure 24:
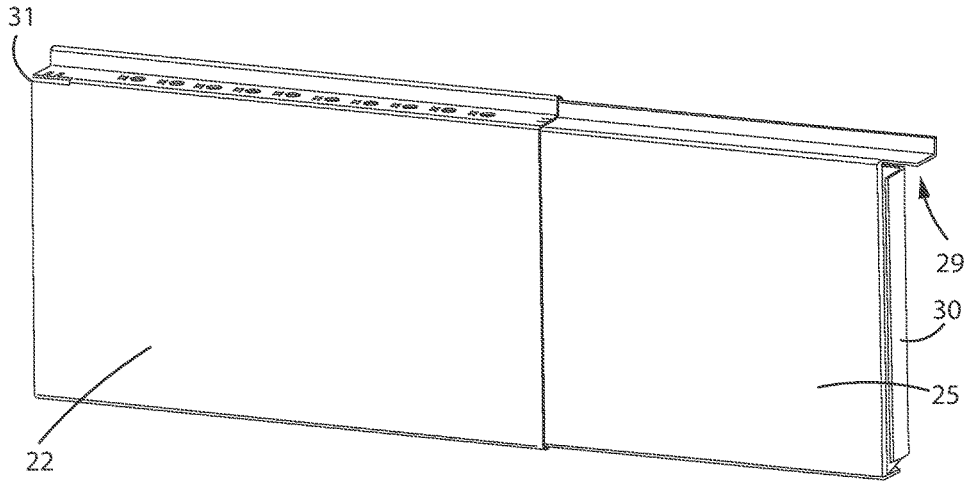
FIG. 24 shows the partial withdrawal of the male member from within the female member to provide a side wall unit of an adjustable length.
Figure 25:
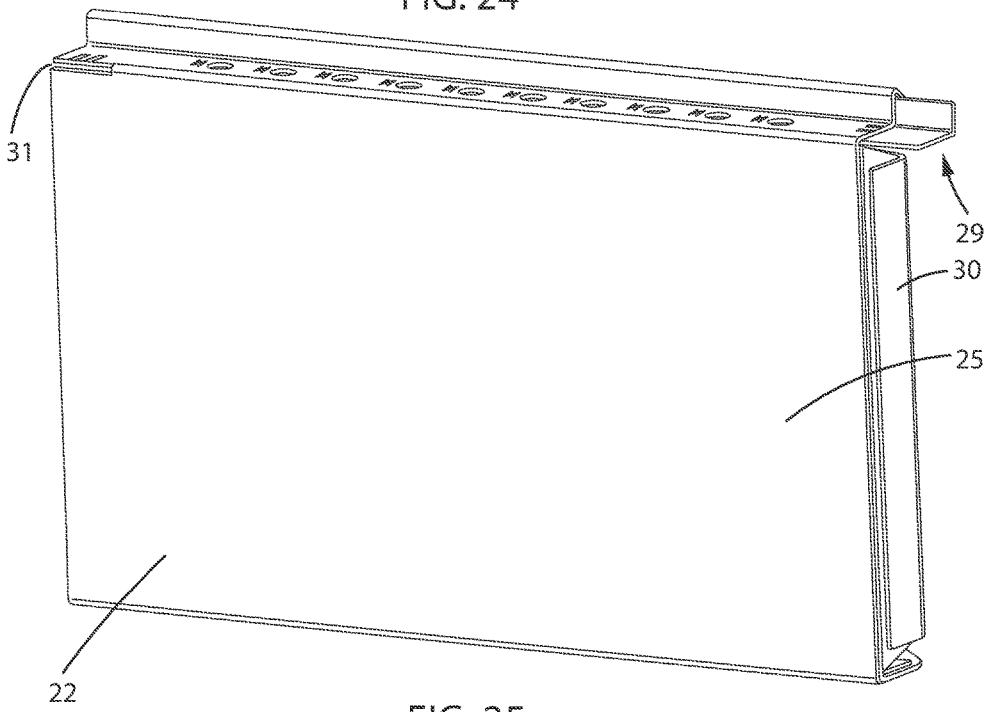
FIG. 25 shows the male member fully inserted into the female member.

FIG. 25 shows the male member (25) fully inserted into the female member (22) giving a minimum length for at least one side wall of the rough-in box (28). The male member (25) is slidably engaged with the female member (22) such that the length of a side wall formed by the male member (25) and female member (22) can be adjusted. FIG. 24 shows the partial withdrawal of the male member (25) from within the female member (22) to provide a side wall unit of an adjusted length. Once the desired length of the side wall of the rough-in box (28) is obtained, the female and male members (22, 25) are secured to each other by a pin, dowel, or nail. A specific type of fastener may also be used that is spring loaded to allow for quick manipulation, or a quarter turn fastener may also be used to allow for quick manipulation.

Figure 26:
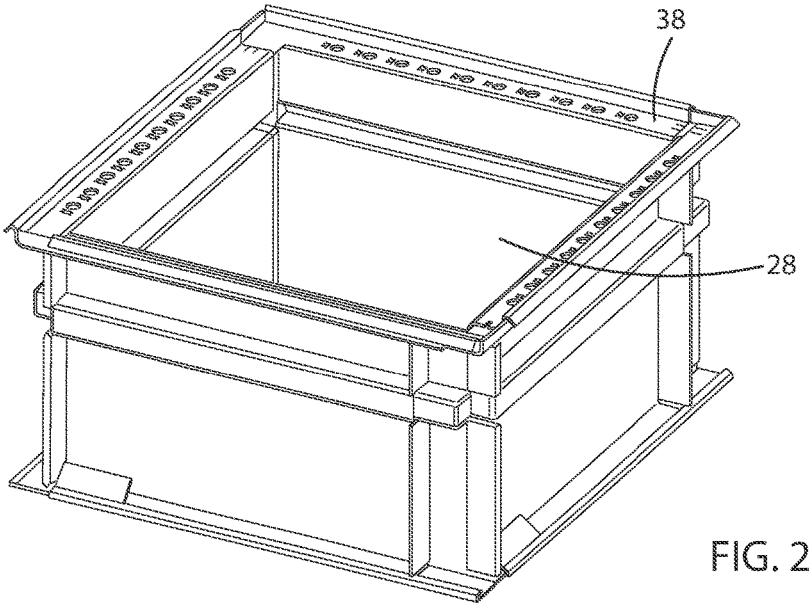
FIG. 26 shows a perspective view of an assembled rough-in box wherein each male member is fully inserted into each female member thereby giving a rough-in box with a minimum length and width.
Figure 27:
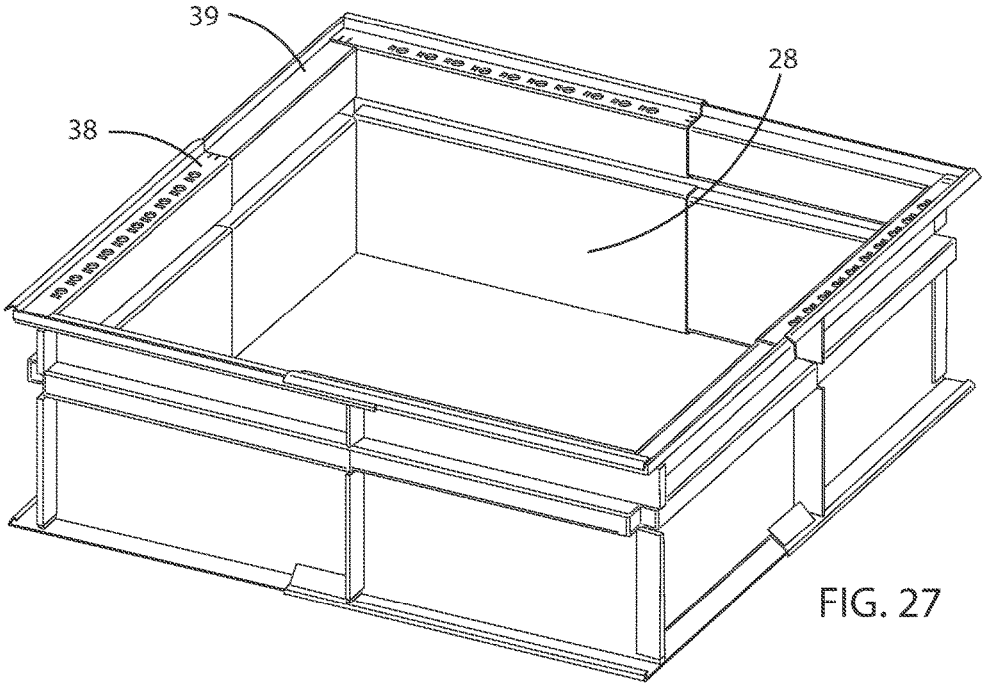
FIG. 27 shows a perspective view of an assembled rough-in box wherein each male member is withdrawn from each female member thereby giving a rough-in box with an adjusted length and width.

FIG. 26 shows a square rough-in box (28) having all four sides with a minimum length when the male member (25) is fully within the perimeter of the female member (22). FIG. 27 shows the rough-in box (28) with the male members (25) partially withdrawn from the female members (22) thereby giving a rough-in box (28) of an adjusted length and width.

Both the female and male members (22, 25) are provided with a flange at the top (38, 39), and each flange (38, 39) is respectively provided with an outer rim (40, 41). The flange (38) on the female member (22) may be provided with a series of apertures (42) which may facilitate the adjustment of the length of the combination of female and male members (22, 25) by sliding the male member (25) into a desired position relative to the female member (22) so as to provide a side wall of an appropriate length. In this manner, each assembly of the female and male members (22, 25) forms a side wall of the rough-in box (28).

Figure 18:
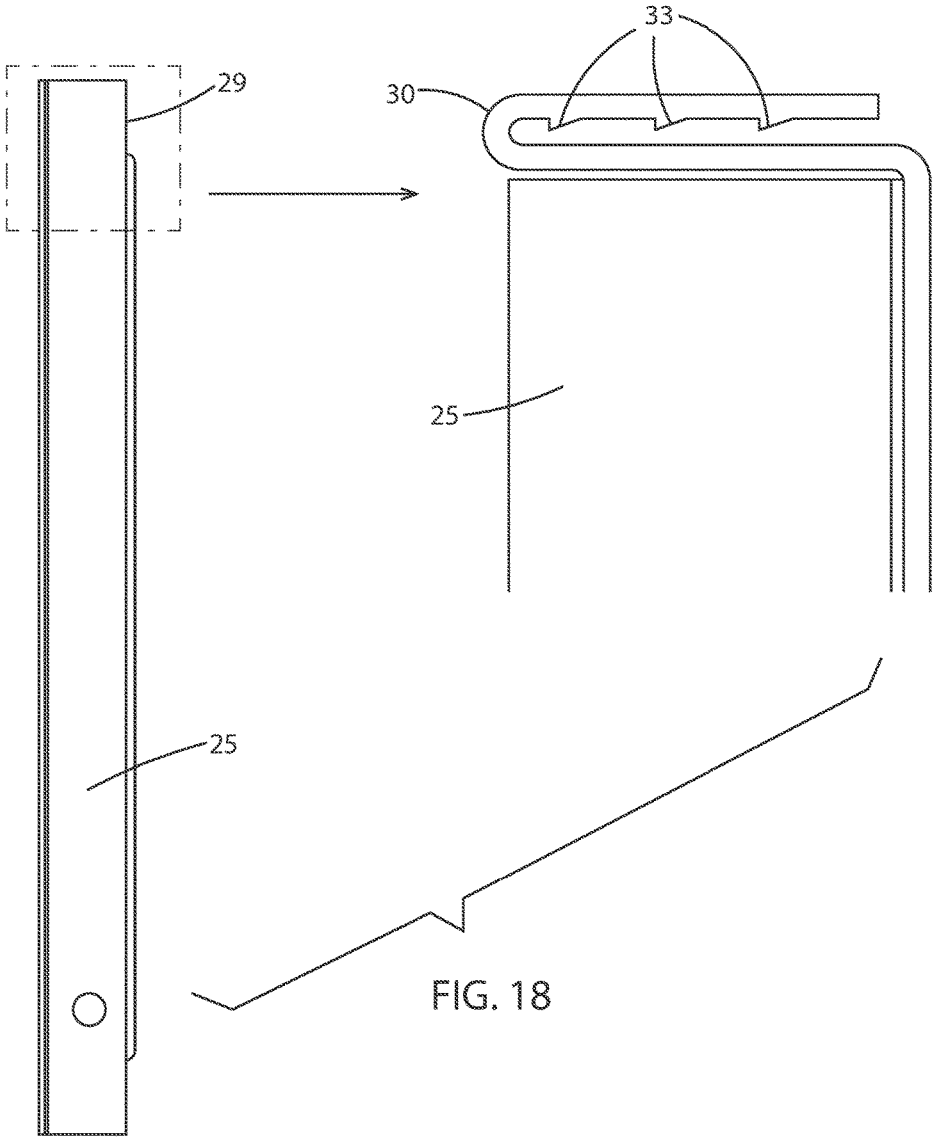
FIG. 18 shows a joint in the top section of the male member.
Figure 19:
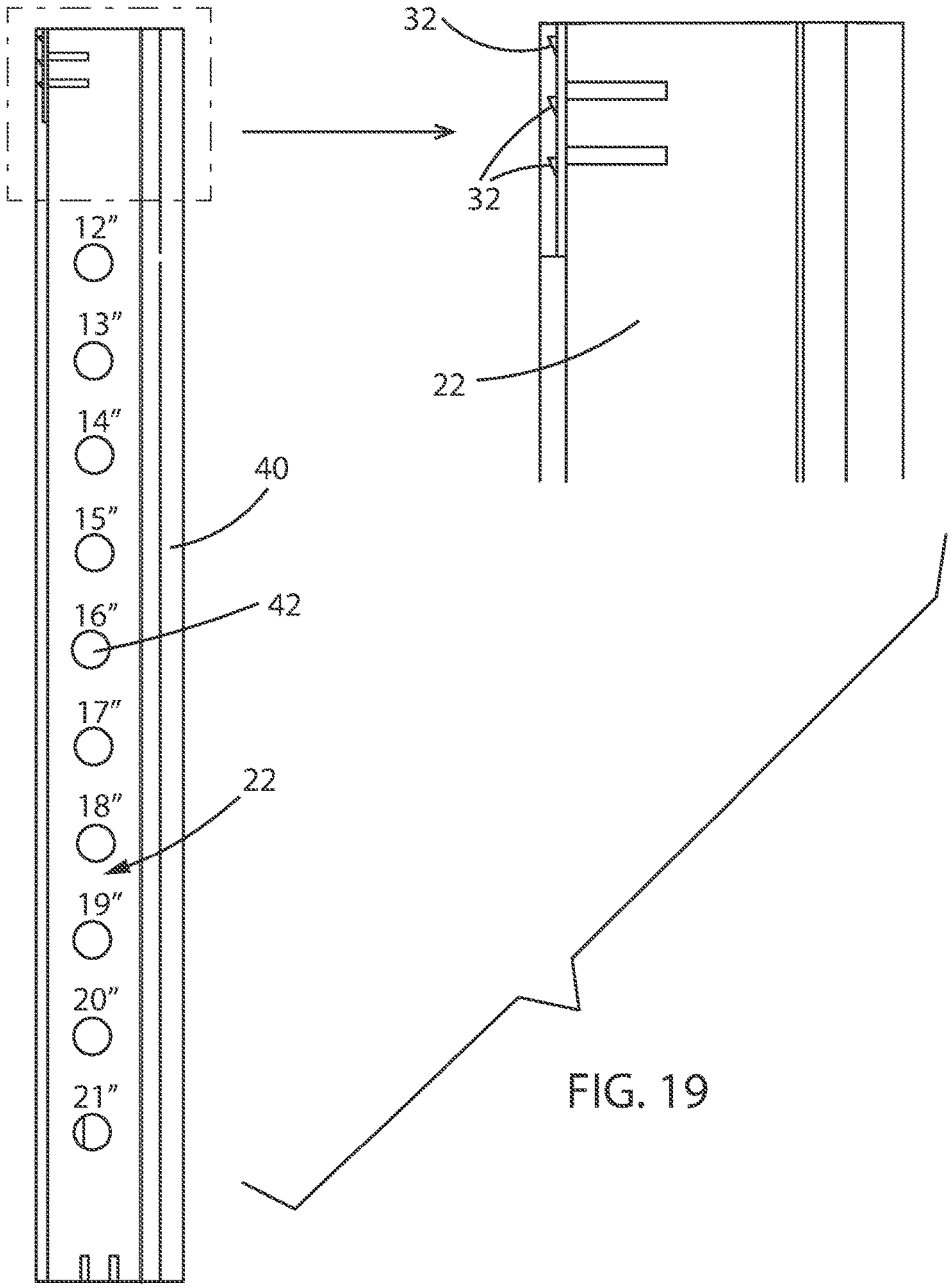
FIG. 19 show a joint in the top section of the female member.

The rough-in box (28) is formed by joining four side walls together. The female member (22) and the male member (25) have corresponding mating faces that interlock when pushed together. Each male member (25) has an extending ridge (29) and a flange (30) on the right side of the internal side (26) as shown in FIG. 16. The flange (30) of the male member (25) has teeth (33) as shown in FIG. 18. The extending ridge (29) and the flange (30) are exposed when the male member (25) is inserted within the female member (22) no matter whether the male member is partially withdrawn from the female member (22) as shown in FIG. 24, or whether the male member is fully inserted within the female member (22) as shown in FIG. 25.

Each female member (22) has a slot (31) on the top left corner of the external side (23) as shown in FIG. 14. Each female member also has groves (32) running down the right edge of the internal side (24) as shown in FIG. 15.

Figure 23:
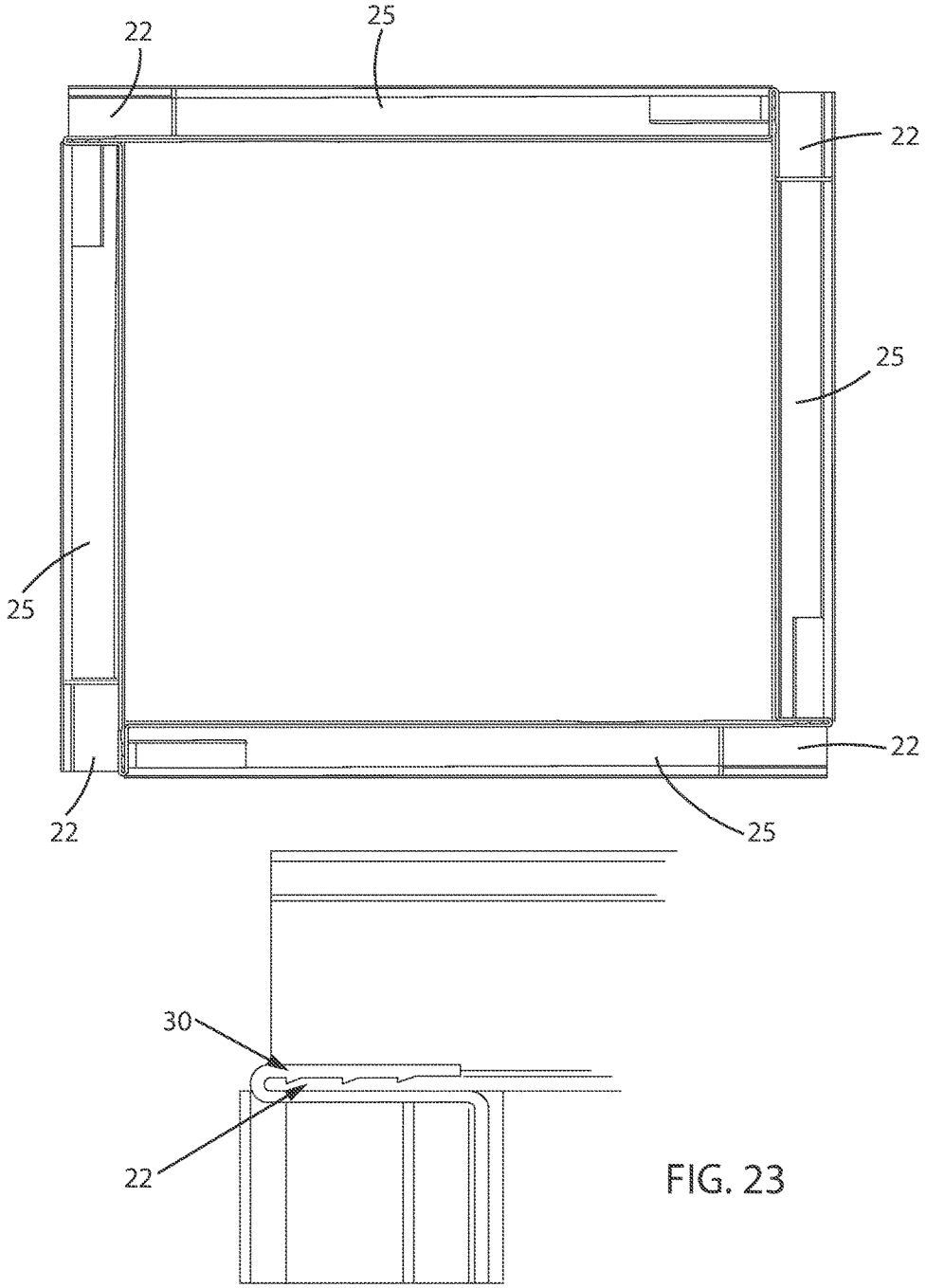
FIG. 23 shows an enlarged view of one corner of the view shown in FIG. 22 showing the mechanism by which the male and female members interlock.

When two side walls of assembled female and male members (22, 25) are joined together, the extending ridge (29) of the male member (25) is fitted into the slot (31) of the female member (22) and the teeth (33) of the flange (30) engage the groves (32) running down the right side of the internal edge (24) of the female member (22). The joint interaction between the male member (25) and the female member (22) is shown in FIG. 23 which is a close-up view of one corner of the assembled rough-in box (28) shown in plan view in FIG. 22. As shown in FIG. 23, the teeth (33) of the flange (30) of the male member (25) engage the grooves (32) of the internal side (24) of the female member (22) at a particular angle which causes a ratcheting effect. This creates a permanent geometrical interference fit. Optionally, the two side walls may also be bolted, screwed, or nailed together as an additional measure for joining the side walls of the rough-in box (28) together.

As indicated above, before joining two side walls together, the length of each side wall can be adjusted by withdrawing the male member from within the female as shown in FIGS. 24 and 25. In this way, the length and width of the rough-in box (28) can be adjusted according to the needs of a particular application or location. For example, a rough-in box (28) with four sides assembled together is shown in FIG. 26 in which the male members (25) are fully inserted within the female members (22) thereby giving a rough-in box (28) with a square shape having a minimum length and a minimum width. Alternatively, FIG. 27 shows a rough-in box (28) with four sides assembled together in which the length of each side has been adjusted by withdrawing each male member (25) from each female member (22) thereby giving a rough-in box (28) with an adjusted length and width.

Figure 20:
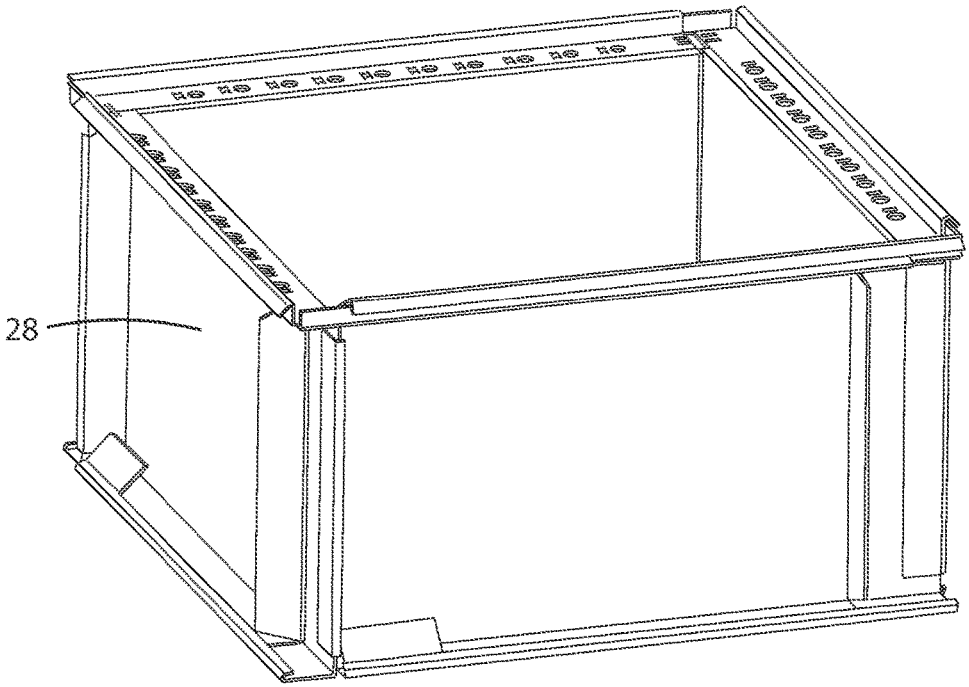
FIG. 20 shows a perspective view of the male and female member joint interaction of an assembled rough-in box.
Figure 21:
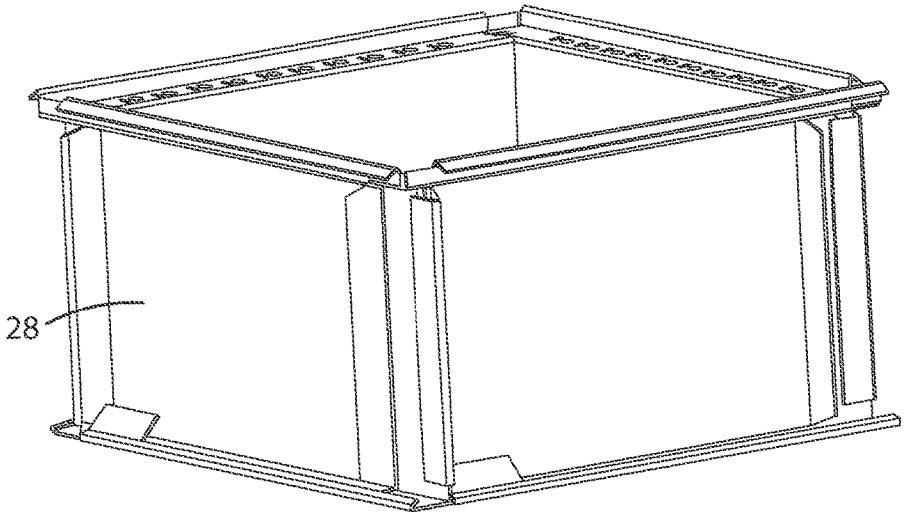
FIG. 21 shows another perspective view of the assembled rough-in box.

Once the lengths of the sides have been appropriately adjusted, additional side walls are joined together in a similar fashion—i.e., the extending ridge (29) of each male member (25) is fitted into the slot (31) of each female member (22) and the teeth (33) of the flange (30) of each male member (25) engage the groves (32) running down the internal edge (24) of each female member (22). FIGS. 20 and 21 show perspective views of a rough-in box (28) having all four sides attached together.

Figure 39:
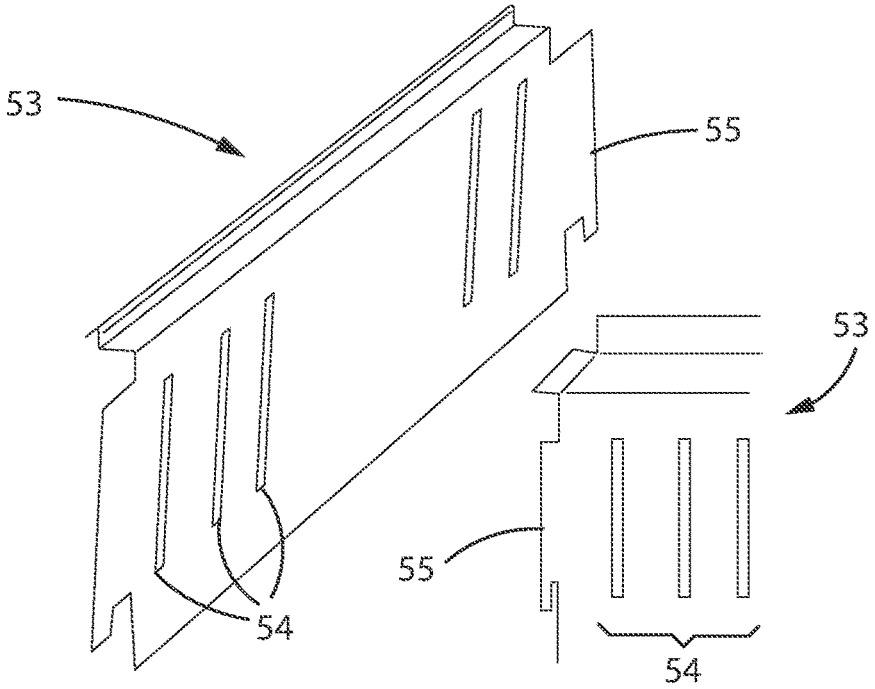
FIG. 39 shows an alternative embodiment for adjusting the length and width of the assembled rough-in box.
Figure 40:
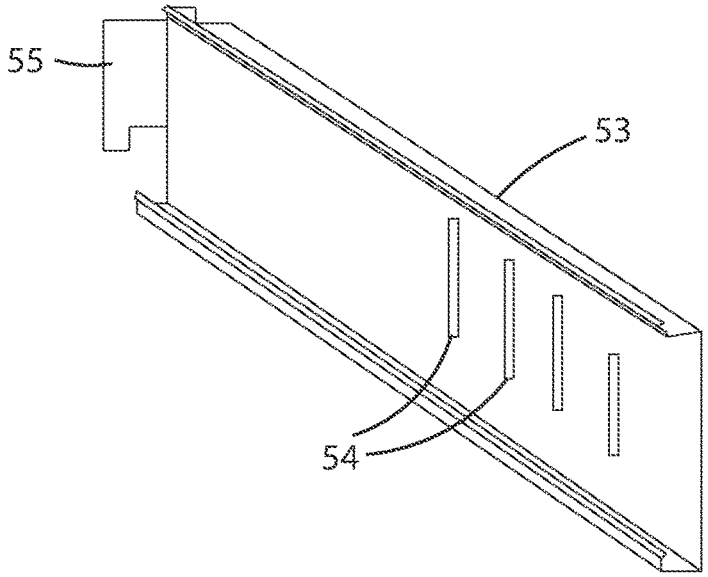
FIG. 40 shows another view of the alternative embodiment for adjusting the length and width of the assembled rough-in box.

In an embodiment different from the one described above, an alternative configuration may be used for adjusting the length and width of the rough-in box (28). This alternative configuration is shown in FIGS. 39 and 40. In this embodiment, side walls (53) can be equipped with a series of parallel slots (54), and the end of each side wall (53) comprises a clip (55) that can be inserted into a slot (54) of another side wall (53). Depending the slot (54) into which the clip (55) is inserted, the length or width of the rough-in box (28) can be adjusted.

The female members (22) and the male members (25) that form each side wall of the rough-in box (28) should be made from a strong, durable material for use in a construction site. Other properties such as the weight of the box can also be relevant to the choice of material for the female and male members (22, 25). For example, these components can be made from aluminum or an aluminum alloy such as, for example, an aluminum 5000 series alloy having a thickness of 0.050 inches.

Figure 38:
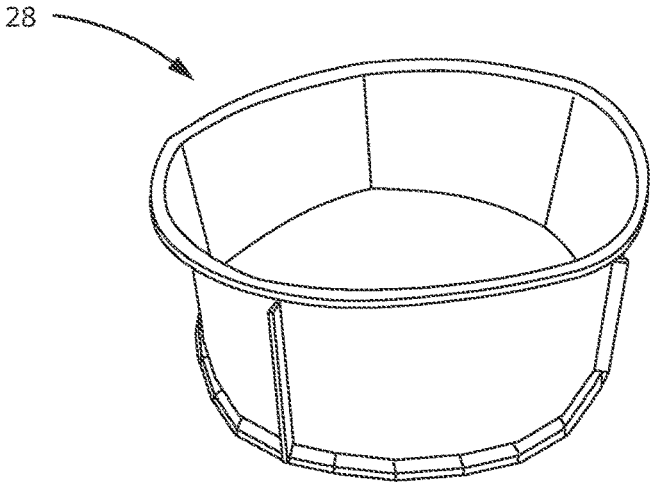
FIG. 38 shows a rounded embodiment of the rough-in box.

In one embodiment, the side walls of the rough-in box (28) are rounded so that instead of a square, rectangular shape, the rough-in box (28) has a rounded, circular shape. In this embodiment, as shown in FIG. 38, the rounded side walls use the same male-female joint system used for the square rough-in boxes (28).

There is no need to have a bottom surface on the rough-in box (28) as that would hinder the installation of plumbing, ducts, or other mechanical systems between floors. Thus, only a lid (34) needs to be opened so that these systems can be passed up from the floors below.

Once the four side walls of the rough-in box (28) are joined together, the lid (34) is attached to the rough-in box (28). Each side wall of the rough-in box (28) is formed with a flange (38, 29) at the top to provide support for the lid (34) so that the lid (34) can be attached to any of the side walls of the rough-in box (28).

The lid (34) is load bearing to permit workmen, equipment, vehicles, and materials to move over the lid (34) without risk of the lid (34) collapsing and caving in. Therefore, the lid (34) needs to be made from a strong enough material to provide a working surface on the floor while construction is being carried out. As such, the lid (34) must be capable of supporting a weight of at least 2,000 pounds and in some applications of supporting weights of up to 20,000 pounds. The lid (34) can he made from fiberglass or from heavy duty plastics such as polyethylene, polyvinyl, and polypropylene. Additionally, in some embodiments, the lid (34) can be made from engineered wood. It is also possible that the lid (34) is made from a combination of fiberglass, heavy duty plastic and/or engineered wood.

In one embodiment, the lid (34) can be made from resin impregnated fiberglass with the density of fibers being determined by the weight that the lid (34) has to bear. The resins used to make the lid (34) can include epoxy resins as well as other types of thermosetting plastics such as polyester or vinylester resins and thermoplastics. Table 1 compares the nominal flexural modulus and strength of several lids varying by the number of piles of fiberglass tape, area weight, and thickness.

| Plies of Tape | 3 | 6 | 10 | 18 |
|---|---|---|---|---|
| Nominal Areal Weight | 0.24 lbs/sq ft | 0.47 lbs/sq ft | 0.79 lbs/sq ft | 1.41 lbs/sq ft |
| | 1.15 kg/sq m | 2.30 kg/sq m | 3.84 kg/sq m | 6.91 kg/sq m |
| Nominal Thickness (in) | 0.030 in | 0.060 in | 0.100 in | 0.180 in |
| | 0.762 mm | 1.524 mm | 2.540 mm | 4.572 mm |
| Nominal Flexural Modulus | 880 ksi | 1250 ksi | 1900 ksi | 2000 ksi |
| Major Direction | 6067 mpa | 8618 mpa | 13099 mpa | 13786 mpa |
| Nominal Flexural Modulus | 195 ksi | 740 ksi | 1300 ksi | 1600 ksi |
| Minor Direction | 1344 mpa | 5102 mpa | 8962 mpa | 11030 mpa |
| Nominal Flexural Strength | 18 ksi | 21 ksi | 34 ksi | 30 ksi |
| Major Direction | 124 mpa | 145 mpa | 234 mpa | 207 mpa |
| Nominal Flexural Strength | 4 ksi | 19 ksi | 23 ksi | 27 ksi |
| Minor Direction | 26 mpa | 131 mpa | 159 mpa | 186 mpa |

Figure 30:
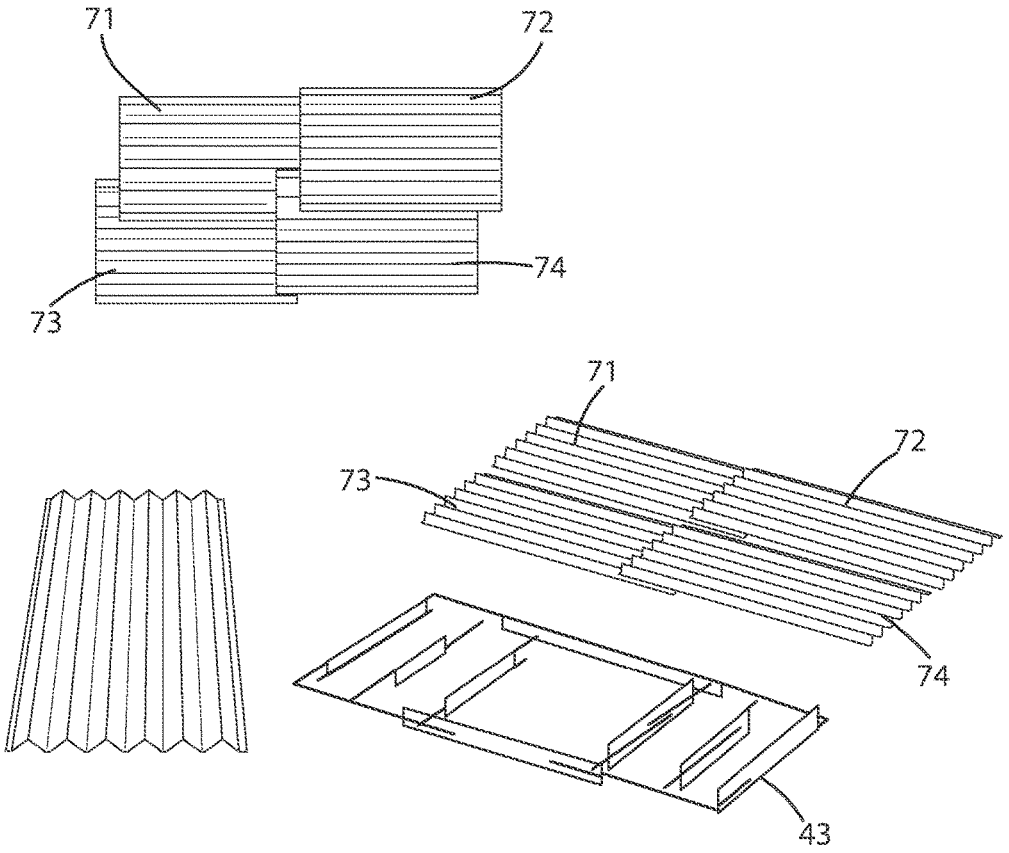
FIG. 30 shows a lid of an adjustable size.

The lid (34) may be custom made to have a fixed size for a particular sized penetration and hence rough-in box (28) or may be of an adjustable size in both the length and width directions. For example, FIG. 30 shows the size of a lid (34) that can be adjusted by providing corrugations in defaces of different parts of the lid (34) so that they can inter-lock with each other while maintaining a strong support. The corrugations are shaped so that the corrugations can dove tail with each other so that they hold together more rigidly. In this embodiment, four sheets (71, 72, 73, 74) having corrugations in their upper and lower surfaces can be used to adjust the size of the lid (34) in both the length direction and width direction. Optionally, only two sheets can be used if adjustment is desired in only one direction (e.g., adjustment in only the length direction or adjustment in only the width direction). For example, two corrugated sheets (73, 74) can slide with respect to one another to increase the length of the lid (34), or two corrugated sheets (71, 73) can be interlocked adjacent to one another to increase the width of the lid (34). Optionally, a frame (43) with two-way adjustability can be used for extra reinforcement of the lid (34) of adjustable size.

Figure 41:
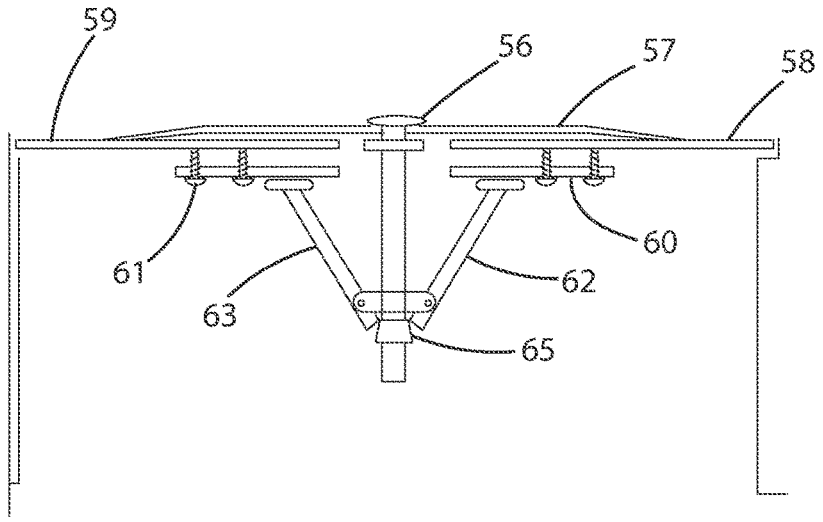
FIG. 41 shows a lid that is capable of expanding by the turning of a screw.
Figure 42:
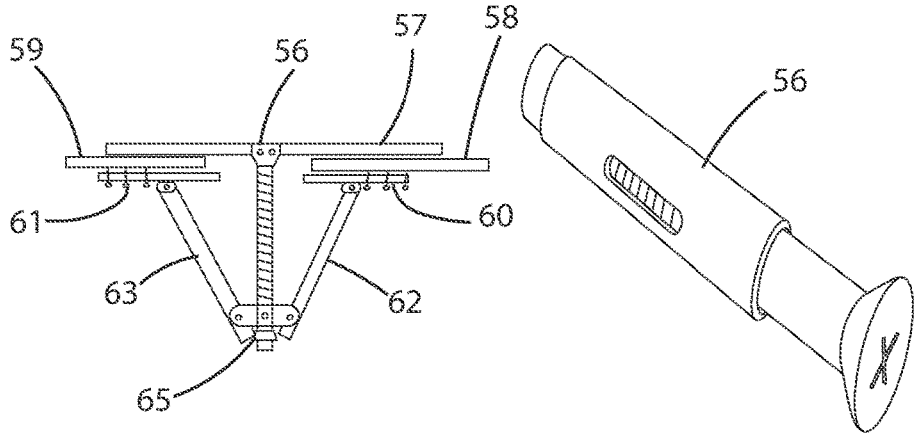
FIG. 42 shows another view of the lid shown in FIG. 41.

In an alternative embodiment, the length or width of the lid (34) can be adjusted by the turning of a screw (56). This embodiment is shown in FIGS. 41 and 42. The screw (56)

is located in the center of a middle panel (57), and as the screw (56) is tightened, it pushes two outer panels (58, 59) in an outward direction. The two outer panels (58, 59) move with brackets (60, 61) which are attached to arms (62, 63) that are connected to a bolt (65). The bolt (65) pulls up when the screw (56) is tightened from the top thereby extending the brackets (60, 61) in opposing outward directions, and thereby increasing the length or width of the lid by pushing the two outer panels (58, 59) in an outward direction.

Figure 28:
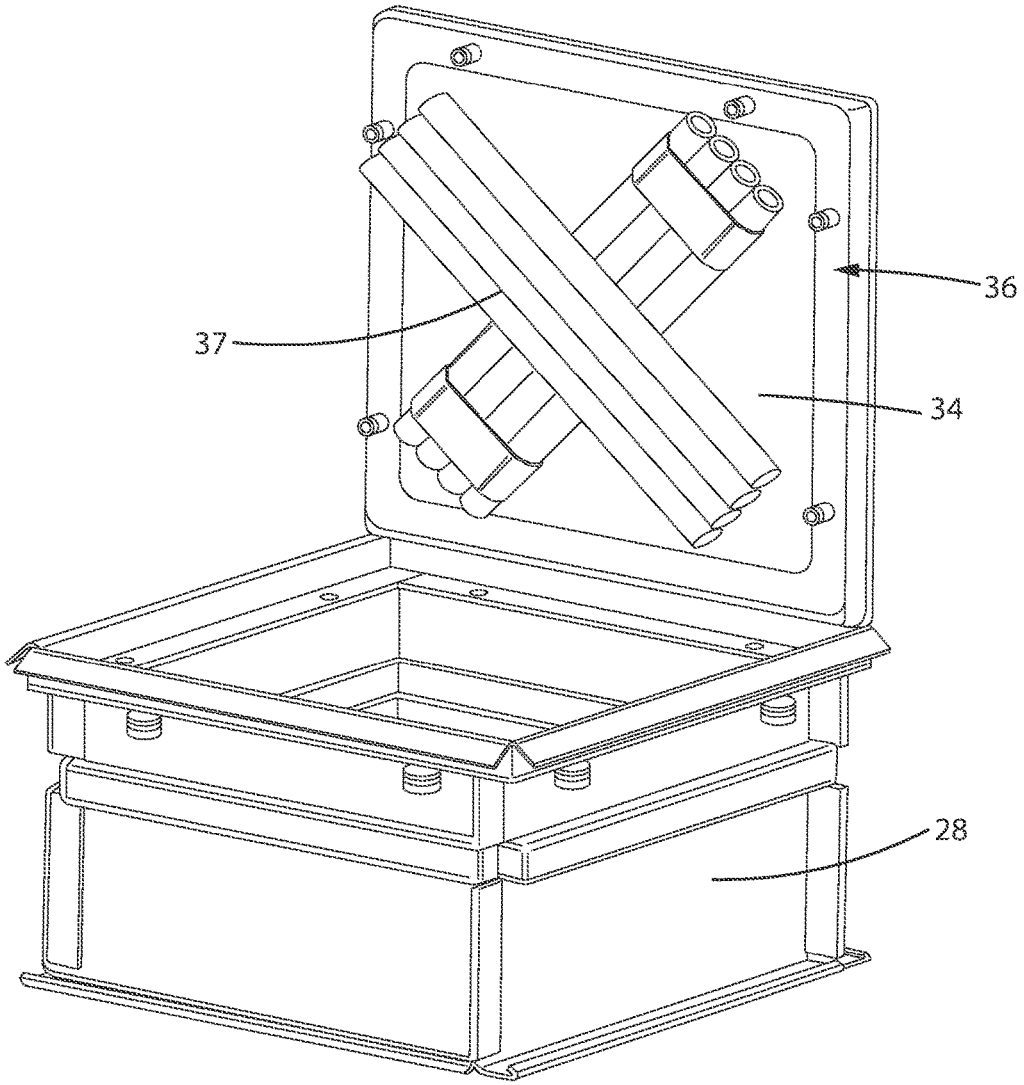
FIG. 28 shows a perspective view of an assembled rough-in box with a lid attached to the top of the rough-in box.
Figure 32:
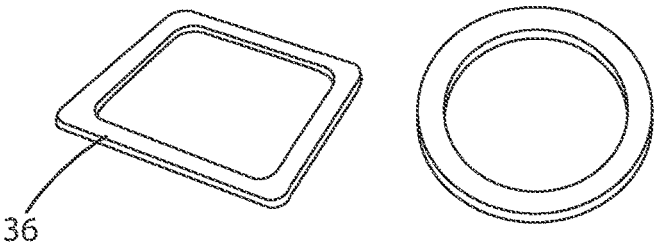
FIG. 32 shows a rubber seal that can be added to the lid of the rough-in box for water resistance.

A fire rated rubber seal (36), such as the one shown in FIG. 32, can be added to the lid (34) for water resistance. As shown in FIG. 28, the seal (36) is added to the under surface of the lid (34) of the rough-in box (28) to create a tight seal with the top surface of the side walls when the rough-in box (28) is closed. Waterproofing the rough-in box (28) allows sheetrock to be stored on floors below without worry of damage.

Figure 37:
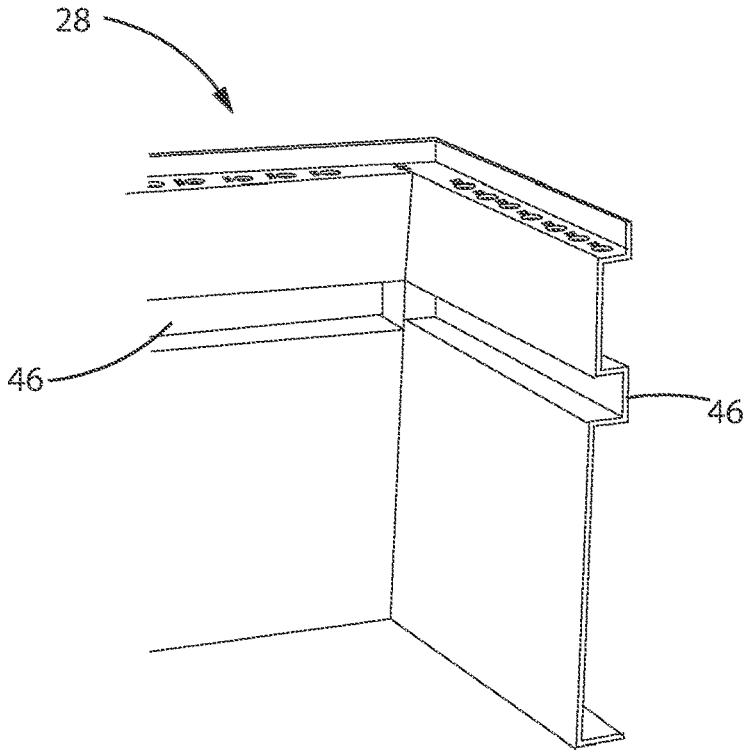
FIG. 37 shows a slot in the side walls of the rough-in box for receiving an expandable foam fireproofing.

Optionally, compressed fireproofing can be embedded into the side walls of the rough-in box (28). As shown in FIG. 37, a slot (46) can be left into the side walls of the rough-in box (28) to receive expandable foam fireproofing. After the rough-in box (28) is assembled and put into place, a worker can pull off a tape that will expose the expandable foam fireproofing. When the tape is removed, the fireproofing will expand until it meets a solid barrier (e.g., air conditioner ducts) such that when a duct is passed through the rough-in box (28), the fireproofing material is adhered to the surface of the duct. The fireproofing material can be an intumescent tape or any equivalent thereof. Intumescent materials that can be included in the tape include for example polyphosphates (such as ammonium polyphosphate) and materials that react with such phosphates such as pentaerythritol and melamine, or silicate-containing materials If desired, the lid (34) can be supported by a strut stretching across the box from an opening or vertical slot in one wall to an opening or vertical slot in an opposite wall to provide additional load bearing strength.

Figure 34:
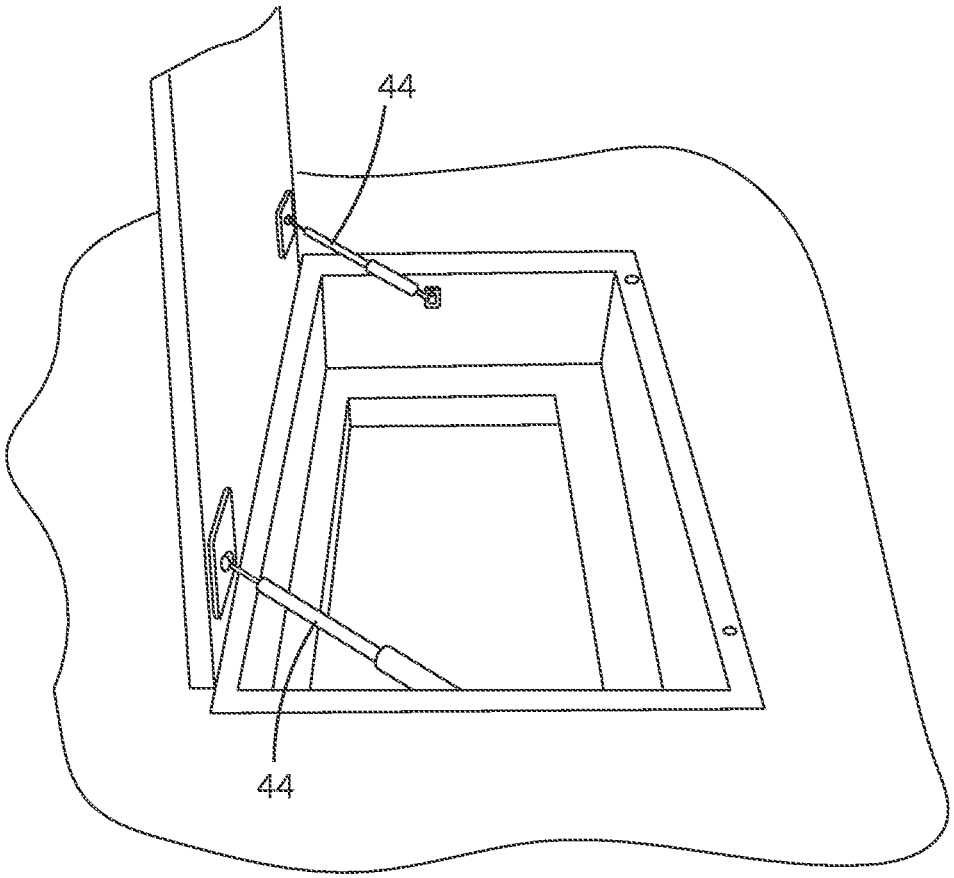
FIG. 34 shows a hydraulic hinges for the lid of the rough-in box.

The lid (34) may be equipped with hydraulic hinges (44) to control the speed that the lid (34) opens and to also keep the lid (34) in a vertical open position when the lid (34) is opened by a worker working on the hole. The hydraulic hinges (44) are shown in FIG. 34.

Figure 35:
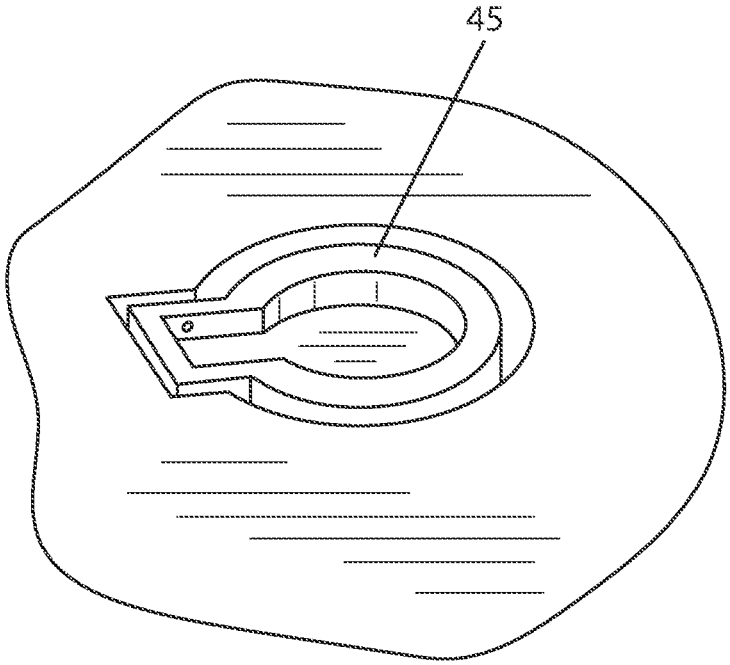
FIG. 35 shows a handle for opening the lid of the rough-in box.

The lid (34) can feature a grip and/or handle (45) for easy opening of the lid (34). An example of a handle (45) is shown in FIG. 35.

Figure 36:
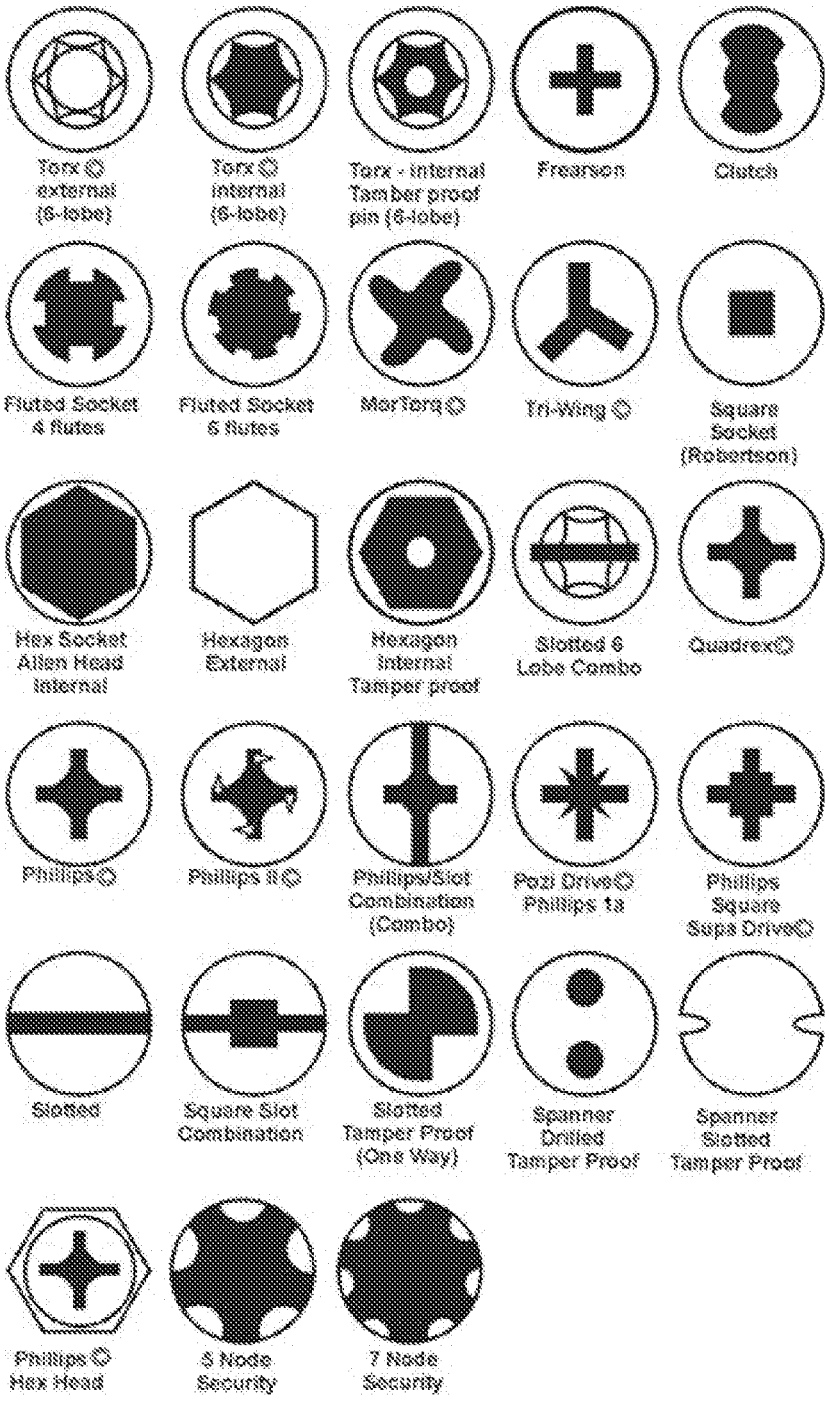
FIG. 36 shows different locks for opening the lid of the rough-in box.

Different locks/screw heads can be utilized so that only certain personnel from a particular trade can open the rough-in box (28). For example, some designated rough-in boxes (28) can be equipped with a special screw head that can only be opened by plumbers, whereas other designated rough-in boxes (28) can be equipped with a different screw head that can only be opened by electricians. Examples of the different types of locks/screw heads that can be used are shown in FIG. 36.

Figure 33:
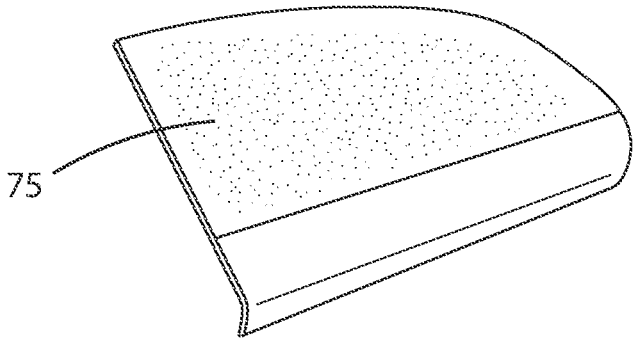
FIG. 33 shows a slip resistant surface that can be applied to the top surface of the lid.

As a safety measure, the lid (34) can have a non-slip surface (75) so that workers and equipment moving over the lid (34) do not slip on the rough-in box (28). A slip resistant surface (75) that can be applied to the lid (34) is shown in FIG. 33.

Figure 29:
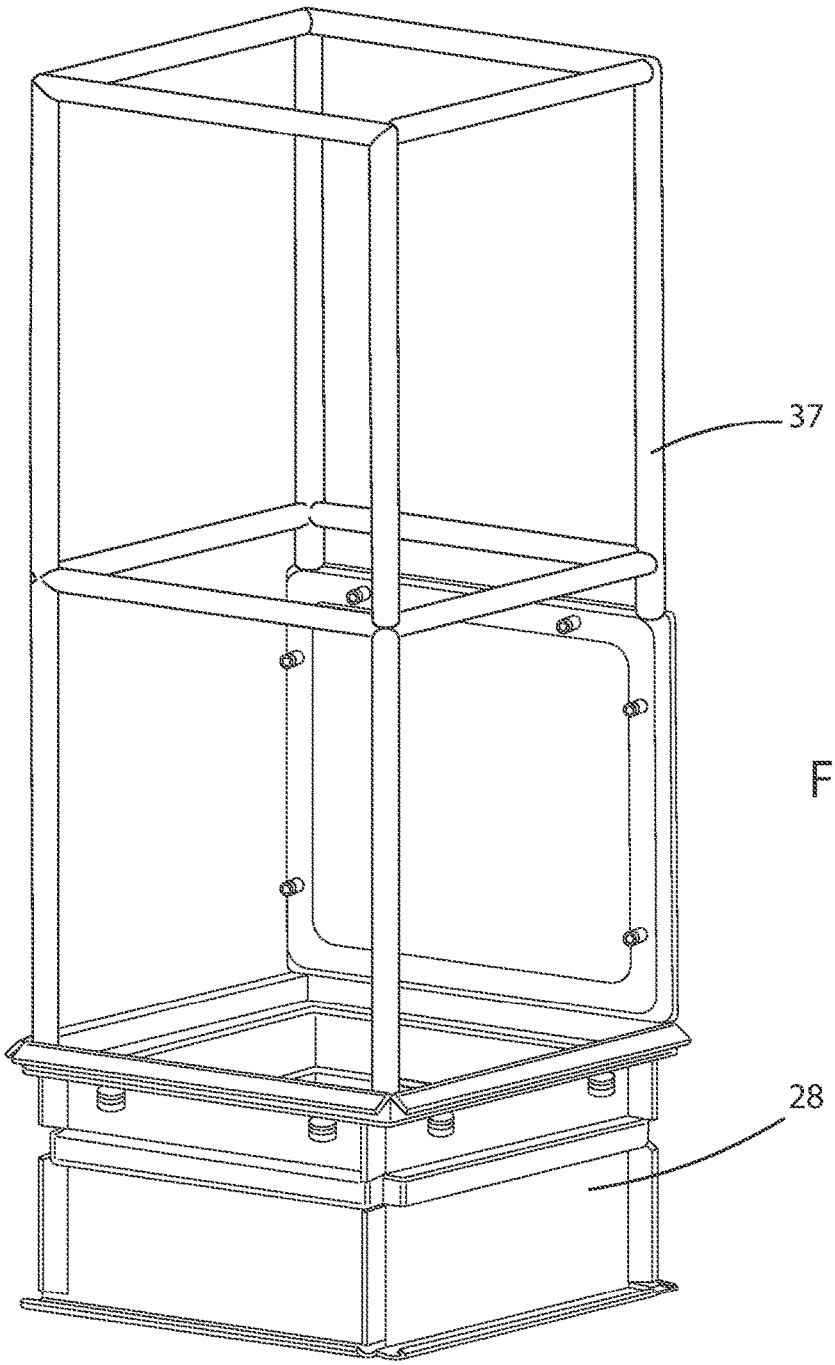
FIG. 29 shows a deployed safety rail for the rough-in box.

As an additional safety measure, the lid (34) can also be equipped with a deployable safety rail (37). The deployable safety rail (37) is a series of tubular members that are connected together and fastened to the rough-in box (28) and the lid (34) when the lid (34) is open to prevent accidental trips and falls due to the hole being open. The deployable safety rail (37) can be collapsed/de-constructed and stored in pieces within the rough-in box (28) on the underside of the lid (34) for storage as shown in FIG. 28. When deployed, the tubular pieces of the safety rail (37) are removed from the underside of the lid (34), and are then assembled together atop the rough-in box (28) to form a rectangular prism that would prevent a worker from falling inside the hole of the rough-in box (28) when the lid (34) is open as shown in FIG. 29. The presence of the deployed safety rail (37) also acts as a warning to workers walking on the construction site that the lid (34) of the rough-in box (28) is open.

A sensing system that would alert workers and staff on the jobsite as to when a particular rough-in box has been left open can be included in the rough-in box (28). For example, a pressure sensor can be integrated into the lid (34), side walls, or both the lid (34) and side walls of the rough-in box (28). When the lid (34) is closed, the sensor will register the applied pressure. When the lid (34) is open, no pressure will be detected by the sensor, and the sensor will then wirelessly relay to a visual display that the rough-in box (28) is open.

When installing the rough-in box (28), a numbering system can be used such that each box is numbered to match a corresponding hole at the jobsite. This ensures that the right rough-in box (28) goes over the correct hole. Also, if lids (34) are removed or placed over the wrong hole, this can be easily inspected and corrected.

The rough-in box (28) with the lid (34) attached allows holes to be covered prior to the pouring of concrete and stops leaks from entering the holes. When the concrete is poured to form the floor of a high-rise building, the lid (34) prevents over-pour from the concrete and creates a perfect edge that is level with the concrete when the concrete solidifies. Thus, there are no obstructions on the floor because the lid (34) will be flush with the concrete floor, allowing for the first time use of dollies, manlifts, modular scaffolding, and designated walkways because the lid (34) is load bearing and capable of handling loads from heavy machines and equipment. As a result, fewer safety personnel are needed and work shutdowns are eliminated.

The rough-in box (28) of the present invention is embedded in the concrete floor, and only the lid (34) needs to be removed during stripping. When the lids (34) are removed, the lids (34) can be easily stacked and removed all together.

Figure 43:
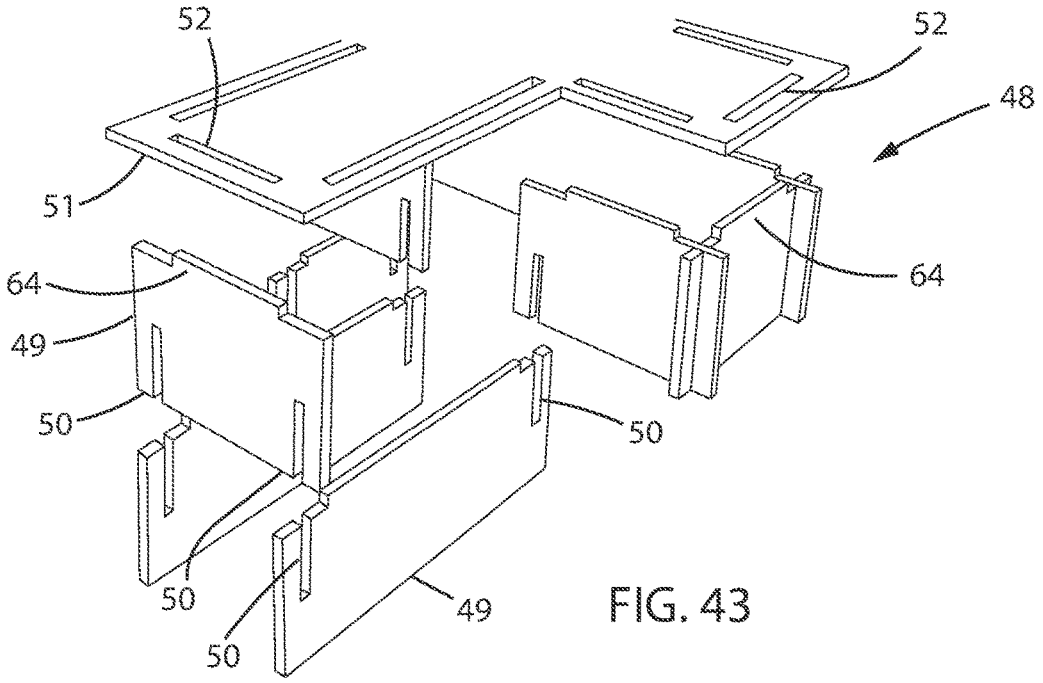
FIG. 43 shows a joint system for a modular construction of a plumber's box.
Figure 44:
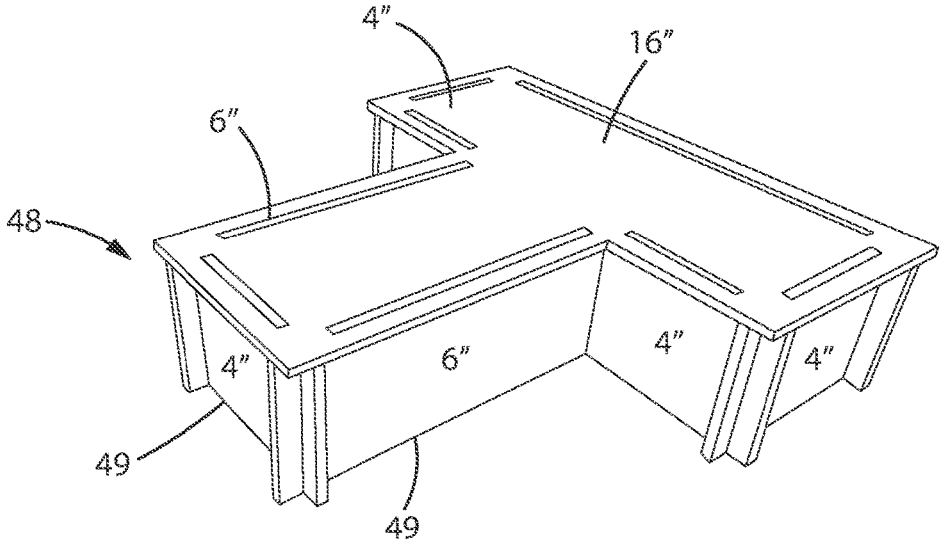
FIG. 44 shows an assembled plumber's box with a bottom attached to the side walls.

FIGS. 43 and 44 show an additional embodiment of the present invention which is a modular construction for a plumber's box (48). In this embodiment, each side wall (49) has a slot (50) on each side. The slot (50) of one side wall (49) will fit into the slot (50) of another side wall (49) when one side wall (49) is inverted upside down. The side walls (49) are comprised of different fixed lengths which can be mixed and matched to create a box (48) of a desirable size and shape.

For example, an assembled T shaped plumber's box (48) is shown in FIG. 44. The T shaped plumber's box (48) is made from side walls (49) having lengths of 4 inches and 6 inches. Additional fixed lengths for the side walls (49) such as 2, 4, 6, 8, 10, 12, or 14 inches are also possible. All of the slots (50) of the side walls (49) have the same shape, and thus the side walls (49), irrespective of length, are compatible with each other.

A bottom (51) may be used to complete the plumber's box (48). The shape and size of the bottom (51) may be custom made to meet the particular shape and size created by the side walls (49) for a particular plumber's box (48). Slits (52) can be cut into the sides of the bottom (51) so that protrusions (64) extending from the bottom of the side walls (49) can be inserted thereby attaching the bottom (51) to the side walls (49), and adding stability and sturdiness to the assembled plumber's box (48).

The side walls (49) and bottom (51) are flat so that when they are loaded for transportation to a worksite, they can be easily stacked on top of another to reduce storage space. In this manner, a plumber's box (48) having a desirable size and shape can be easily and efficiently constructed from components that significantly reduce storage space.

While the present invention has been described above in terms of specific embodiments, it is to be understood that the invention is not limited to these disclosed embodiments. Many modifications and other embodiments of the invention will come to the mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

We claim:

1. A rough-in-box kit for creating a rough-in box to create penetrations in poured concrete flooring during construction of buildings, comprising:

a front side wall having:
- a left end;
- a right end; and
- a top end:

a left side wall having:
- a front end configured to directly connect with the left end of the front side wall to form a front-left corner of the box;
- a rear end; and
- a top end;

a rear side wall having:
- a left end configured to directly connect with the rear end of the left side wall to form a rear-left corner of the box; and
- a right end; and
- a top end;

a right side wall having:
- a front end configured to directly connect with the right end of the front side wall to form a front-right corner of the box;
- a rear end configured to directly connect with the right end of the rear side wall to form a rear-right corner of the box; and
- a top end; and a lid that is configured to rest on the top ends of the side walls when the side walls are connected to each other to form the rough-in box;

wherein each of the side walls comprises:
- a first mating end portion; and
- a second mating end portion configured to engage with the first mating end portion of one of the other side walls so as to connect the two sidewalls to each other and form one of the corners of the box.

2. The rough-in-box kit of claim 1;

wherein the first mating end portion of each of the side walls is a female end portion; and wherein the second mating end portion of each of the side walls is a male end portion configured to be arranged within the female end portion of one of the other side walls so to connect the two sidewalls to each other.

3. A rough-in-box kit for creating a rough-in box to create penetrations in poured concrete flooring during construction of buildings, comprising:

a front side wall having:
- a left end;
- a right end; and
- a top end:

a left side wall having:
- a front end configured to directly connect with the left end of the front side wall to form a front-left corner of the box;
- a rear end; and
- a top end;

a rear side wall having:
- a left end configured to directly connect with the rear end of the left side wall to form a rear-left corner of the box; and
- a right end; and
- a top end;

a right side wall having:
- a front end configured to directly connect with the right end of the front side wall to form a front-right corner of the box;
- a rear end configured to directly connect with the right end of the rear side wall to form a rear-right corner of the box; and
- a top end; and a lid that is configured to rest on the top ends of the side walls when the side walls are connected to each other to form the rough-in box;

wherein the side walls each comprise a fireproof material.

4. The rough-in-box kit of claim 3;

wherein each of the side walls is made of an aluminum alloy.

5. The rough-in-box kit of claim 3;

wherein each of the side walls comprises a groove configured to accept insertion of an expandable fireproofing material.

6. The rough-in-box kit of claim 3;

wherein at least one of the side walls is of an adjustable length.

7. The rough-in-box kit of claim 3;

wherein the side walls are connected to one another by a permanent geometrical interference fit.

8. The rough-in-box kit of claim 3;

wherein the top end of each of the side walls comprises:
- a flange; and
- a rim that extends from an outside end of the flange when the side walls are connected to each other to form the box; and wherein the lid is configured to rest on the flanges of the side walls so that a top surface of the lid is flush with a top surface of the rims when the side walls are connected to each other to form the box.

9. The rough-in-box kit of claim 3;

wherein an under surface of the lid comprises a seal configured to create a waterproof seal with the top ends of the side walls when the side walls are connected to each other to form the box and the lid is placed on the top ends of the side walls.

10. The rough-in-box kit of claim 3;

wherein the lid is formed so as to support a weight of at least 2,000 pounds when the side walls are connected to each other to form the box and the lid is rested on the top ends of the side walls.

11. The rough-in-box kit of claim 3, further comprising:

a bottom wall;

wherein the bottom wall forms a single and continuous integrated piece with at least two of the side walls.

12. The rough-in-box kit of claim 3;
wherein the lid is formed of resin-impregnated fiberglass.
13. The rough-in-box kit of claim 12;
wherein the resin-impregnated fiberglass is impregnated with an epoxy resin.
14. The rough-in-box kit of claim 12;
wherein the lid comprises 18 to 40 fiberglass layer strands of fiber.
15. The rough-in-box kit of claim 3;
wherein at least one side wall of the front, left, rear, and right side walls comprises:
a first piece having a first end and a second end; and
a second piece having a first end and a second end;
wherein the first end of the first piece is configured to connect with one of the ends of one of the other side walls;
wherein the second end of the first piece is configured to engage with the first end of the second piece so as to create the at least one side wall; and
wherein the second end of the second piece is configured to connect with one of the ends of another one of the other the side walls.
16. The rough-in-box kit of claim 15;
wherein the first piece comprises a female component; and
the second piece comprises a male component configured to be arranged within the female component so to connect the first and second piece to each other to form the at least one side wall.
17. The rough-in-box kit of claim 3;
wherein each of the side walls comprises:
a first mating end portion; and
a second mating end portion configured to engage with the first mating end portion of one of the other side walls so as to connect the two sidewalls to each other and form one of the corners of the box.
18. The rough-in-box kit of claim 17;
wherein the first mating end portion of each of the side walls is a female end portion; and
wherein the second mating end portion of each of the side walls is a male end portion configured to be arranged within the female end portion of one of the other side walls so to connect the two sidewalls to each other.
19. The rough-in-box kit of claim 3, further comprising:
a sensing system configured to detect when the lid is lifted off of at least one of the side walls.
20. The rough-in-box kit of claim 19;
wherein the sensing system comprises a pressure sensor.
21. The rough-in-box kit of claim 19;
wherein at least a part of the sensing system is arranged on or in one or more of the side walls, the lid, or a combination thereof.
22. The rough-in-box kit of claim 19;
wherein the sensing system comprises a visual display that visually displays an indication when the sensing system detects that the lid is lifted off of at least one of the side walls.
23. The rough-in-box kit of claim 3, further comprising:
a safety rail system configured to connect with the box when the side walls are connected to each other to form the box.
24. The rough-in-box kit of claim 23;
wherein the safety rail system is configured to connect with the box to form a rectangular prism.
25. The rough-in-box kit of claim 23;
wherein the safety rail system is further configured to connect with the lid when the side walls are connected to each other to form the box and the lid is arranged in an open position on the box.
26. The rough-in-box kit of claim 23;
wherein the safety rail system comprises a plurality of tubular members configured to be stored within the box when the side walls are connected to each other to form the box and the safety rails system is not in use.
27. The rough-in-box kit of claim 26;
wherein the plurality of tubular members is configured to be stored within the box by attaching to an underside of the lid.
28. The rough-in-box kit of claim 3:
wherein the lid is configured to be adjustable in size in a length direction, a width direction, or a combination thereof.
29. The rough-in-box kit of claim 28:
wherein the lid comprises:
a first part; and
a second part configured to connect with the first part at a plurality of positions so as to adjust the length direction or the width direction of the lid.
30. The rough-in-box kit of claim 29:
wherein the second part is configured to connect with the first part at a plurality of positions so as to adjust the length direction of the lid; and
wherein the lid further comprises:
a third part configured to connect with the first part, the second part, or both, at a plurality of positions so as to adjust the width direction of the lid.
31. The rough-in-box kit of claim 29:
wherein the first part comprises first corrugations; and
wherein the second part comprises second corrugations configured to engage with the first corrugations of the first part at a plurality of positions so as to adjust the length direction or the width direction of the lid.
32. The rough-in-box kit of claim 29, further comprising:
a screw that is configured to adjust a position, from among the plurality of positions, of the first part with respect to the second part, thereby adjusting the length direction or the width direction of the lid.
33. A method of constructing a concrete floor containing penetrations, the method comprising:
providing the rough-in-box kit according to claim 1;
connecting the side walls of the rough-in-box kit to form the box;
placing the lid on the top ends of the side walls of the box;
pouring concrete to form the floor around the box;
performing work on the floor after pouring the concrete; and
installing fittings and tubing within the box while the box is in situ in the concrete.

* * * * *